US006038782A

United States Patent [19]

Schepisi

[11] Patent Number: 6,038,782

[45] **Date of Patent: *Mar. 21, 2000**

[54] BLOW DRYER HAVING AIRFLOW CONTROL MEANS

[75] Inventor: Natale Schepisi, Mamaroneck, N.Y.

[73] Assignee: Vital Hair Tools, LLC, Mamaroneck, N.Y.

[ * ] Notice: This patent is subject to a terminal disclaimer.

[21] Appl. No.: 09/018,616

[22] Filed: Feb. 4, 1998

[51] Int. Cl.[7] ..... A45D 2/36

[52] U.S. Cl. ..... 34/97; 34/98; 132/226; 239/437; 239/562; 392/374; 392/379; 392/385

[58] Field of Search ..... 34/90, 96, 97, 34/98, 99, 100, 231; 392/465, 485, 491, 374, 379, 380, 383, 384, 385; 132/227, 228, 268, 269, 271, 272; 219/507, 508, 222; 239/436, 437, 443, 562, 578

[56] References Cited

U.S. PATENT DOCUMENTS

| | | | |
|---|---|---|---|
| D. 228,696 | 10/1973 | Bluestein | D4/121 |
| D. 259,964 | 7/1981 | Edelen | D28/37 |
| D. 274,551 | 7/1984 | Benjamin et al. | D8/29.1 |
| D. 306,357 | 2/1990 | Scorgie | D28/35 |
| 2,954,788 | 10/1960 | Madore | 132/262 |
| 3,472,245 | 10/1969 | Abe | 132/233 |
| 3,860,174 | 1/1975 | Cercone | 239/135 |
| 3,955,065 | 5/1976 | Chambon | 392/384 |
| 4,097,722 | 6/1978 | Soler et al. | 392/385 |
| 4,218,608 | 8/1980 | Maroney | 392/385 |
| 4,232,454 | 11/1980 | Springer | 34/97 |
| 4,525,623 | 6/1985 | Da Silva | 392/379 |
| 4,605,019 | 8/1986 | Reynolds et al. | 132/272 |
| 4,656,684 | 4/1987 | Jewett | 15/27 |
| 4,685,479 | 8/1987 | McClean | 132/229 |
| 5,091,630 | 2/1992 | Djuric | 219/222 |
| 5,148,512 | 9/1992 | Owens | 392/383 |
| 5,157,757 | 10/1992 | McDougall | 392/383 |
| 5,467,540 | 11/1995 | Bastien | 34/97 |
| 5,507,103 | 4/1996 | Merritt | 34/97 |
| 5,598,640 | 2/1997 | Schepisi | 34/97 |
| 5,661,910 | 9/1997 | Schepisi | 34/97 |
| 5,842,286 | 12/1998 | Cantor | 34/96 |

FOREIGN PATENT DOCUMENTS

85/03849 9/1985 WIPO .

*Primary Examiner*—Pamela A. Wilson
*Attorney, Agent, or Firm*—Oblon, Spivak, McClelland, Maier & Neustadt, P.C.

[57] ABSTRACT

In one embodiment a blow dryer includes a barrel having an opening. A deflector, having an aperture, positioned within or substantially within the barrel. The hand-held blow dryer can be utilized in at least a first or open mode in which air flow is directed through the barrel opening of the barrel, and a final or fully deflecting mode. Thus, in the fully deflecting mode most of the air is deflected by the deflector so as to diffuse the airflow. Additionally, the shape of the deflector allows the airflow to be maintained while the deflector is in any position, thus, allowing the airflow to flow past the heating coils in the barrel so that potential overheating of the blow dryer is reduced. In another embodiment, a gap is provided between two flaps which comprise the deflector so as to achieve the same result. In still another embodiment, rings are provided around the circumference of a barrel having holes in the barrel. The rings diffuse the air emanating out of the holes and also guide the hair for styling. In yet still another embodiment, barrel attachments are provided to be removably attached around a barrel having holes in it so as to achieve results similar to that as the embodiment having rings. In a further embodiment, a stop mechanism allows for at least an open position, an intermediate position, and a fully diffusing position of the flaps, which is adjustable using one hand of the user.

22 Claims, 28 Drawing Sheets

1
3
4
5
5a
6
7
8
8a
11
12
16
16'
16"
16a
16b
16c
A

BLOW DRYER HAVING AIRFLOW CONTROL MEANS

CROSS REFERENCES TO RELATED APPLICATIONS

The present invention is related to commonly owned U.S. Pat. Nos. 5,598,640 and 5,661,910 all of which are incorporated herein by reference.

BACKGROUND OF THE INVENTION

1. Field of the Invention

The present invention provides for an enhancement to a professional hair dressing blow dryer, more specifically to the blow dryer's barrel which permits variable and more diffuse airflow, saves energy, is easy to use, and reduces any potential overheating problem.

2. Discussion of the Related Art

Conventional hair dressing "pistol-type" blow dryers utilize a one-directional airflow through a front opening of a cylindrical conduit or barrel of the blow dryer. Commercial attachments which are available to fit over the barrel opening to vary airflow require a two-handed operation.

U.S. Pat. No. 4,097,722 describes a mechanism for varying airflow by controlling an area of the barrel opening by a deflector which is activated by the trigger. However, this patent does not disclose airflow from the barrel surface itself.

U.S. Pat. No. 4,232,454 controls airflow from the barrel opening by the use of trap doors activated by a knob and a screw. This has a drawback in that it also requires a two-handed operation.

U.S. Pat. No. 5,157,757 describes variations of airflow, including secondary outlets on a barrel. However, this device like the remaining devices requires a two-handed operation, since full activation depends upon manual rotation of a collar, manual settings, as well as a trigger-operated baffle to vary the barrel opening.

During hair styling utilizing a blow dryer, hair dressers use the blow dryer in one hand and point the barrel opening at the hair to be styled. A brush or other styling tool is utilized in the other hand. Additionally, when blow styling medium to long length hair, hair dressers use the barrel horizontally with the barrel opening pointed away from the head, to lift hair for the subsequent insertion of the tool in the other hand. During this function, air flow from the barrel opening is wasted, and the barrel itself affords no benefit of any drying/styling capability.

Thus, conventional blow dryer devices do not provide for a barrel arrangement in which air can be directed through the barrel surface of the blow dryer. Furthermore, conventional blow dryers do not provide for attachments and other devices to diffuse the airflow emanating out of the barrel surface and to guide the hair. Additionally, conventional blow dryer devices do not provide for an efficient mechanism which permits a user to deflect air flow from the opening of the barrel of the blow dryer by using a simple one-handed operation.

SUMMARY OF THE INVENTION

The present invention therefore provides for a blow dryer arrangement which overcomes the drawbacks of conventional arrangements discussed above.

The blow dryer arrangement of the present invention adds functionality to the blow dryer by varying airflow from the barrel opening, while conserving energy use. This permits the blow dryer of the present invention to be utilized for horizontal lifting/drying/styling, as well as a hot roller and diffuser, concentrator and finisher.

The present invention therefore provides a blow dryer which comprises a barrel having an opening; a deflector positioned substantially within the barrel, the deflector being movable between at least an open position in which the barrel opening is opened, and a deflecting position in which the barrel opening is substantially closed, with the deflector having at least one aperture so as to diffuse air flowing through the deflector. When the deflector is moved to an intermediate position, between the open and closed positions, the airflow emanating from the barrel opening is concentrated.

The present invention therefore provides a blow dryer which comprises a barrel having an opening; a deflector positioned substantially within the barrel, the deflector being movable between at least an open position in which the barrel opening is opened, and a deflecting position in which the barrel opening is substantially closed, the deflector comprising first and second flaps, where in the deflecting position each flap having a facing surface, the facing surfaces face each other and are separated by a gap so as to diffuse air passing through the gap.

The present invention also provides for a blow dryer which comprises a barrel having an opening, with the barrel comprising a plurality of holes which are disposed around a circumference of the barrel and are spaced along substantially an entire length of the barrel; and rings spaced around the length of the barrel and which extend around the circumference of the barrel, where some of the rings obstruct air flowing out of the holes in the barrel and other rings which do not obstruct the flow of air out of the holes in the barrel, so that the rings can help style hair and the rings that partially obstruct the air flow diffuse the air flow to further help style the hair.

The present invention also provides for a blow dryer which comprises a barrel having an opening, with the barrel having holes disposed around and along the length of the barrel; and a barrel attachment surrounding the barrel so as to partially obstruct the flow of air out of the holes, where the barrel attachment is used to style hair.

Also, the present invention also provides for a blow dryer which comprises a barrel having an opening, with the barrel having holes disposed around and along the length of the barrel; and a barrel attachment surrounding the barrel, where the barrel attachment is used to style hair.

The blow dryer arrangement of the present invention includes a deflector associated with the barrel. By actuation of an actuator, the deflector associated with the barrel can gradually close down most of the airflow in varying degrees.

This effects airflow from the opening of the barrel so as to provide a diffuse airflow, which at the same time reduces any potential overheating problems of the heating coils within the barrel of the blow dryer, by providing airflow out of the barrel.

The present invention includes a stop mechanism partially attached to the actuator and partially attached to the barrel.

The stop mechanism provides stop positions so that the deflector can be maintained in an at least open, intermediate, or fully deflecting position.

The present invention also provides for an actuator which comprises a rack gear connected to the actuator which engages with at least two rotatable gears. The at least two rotatable gears are mounted on rotating shafts of the deflector, such that a movement of the actuator causes a movement of the rack gear which causes a rotation of the at least two gears to thereby cause the movement of the deflector.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 2, 3, 4:
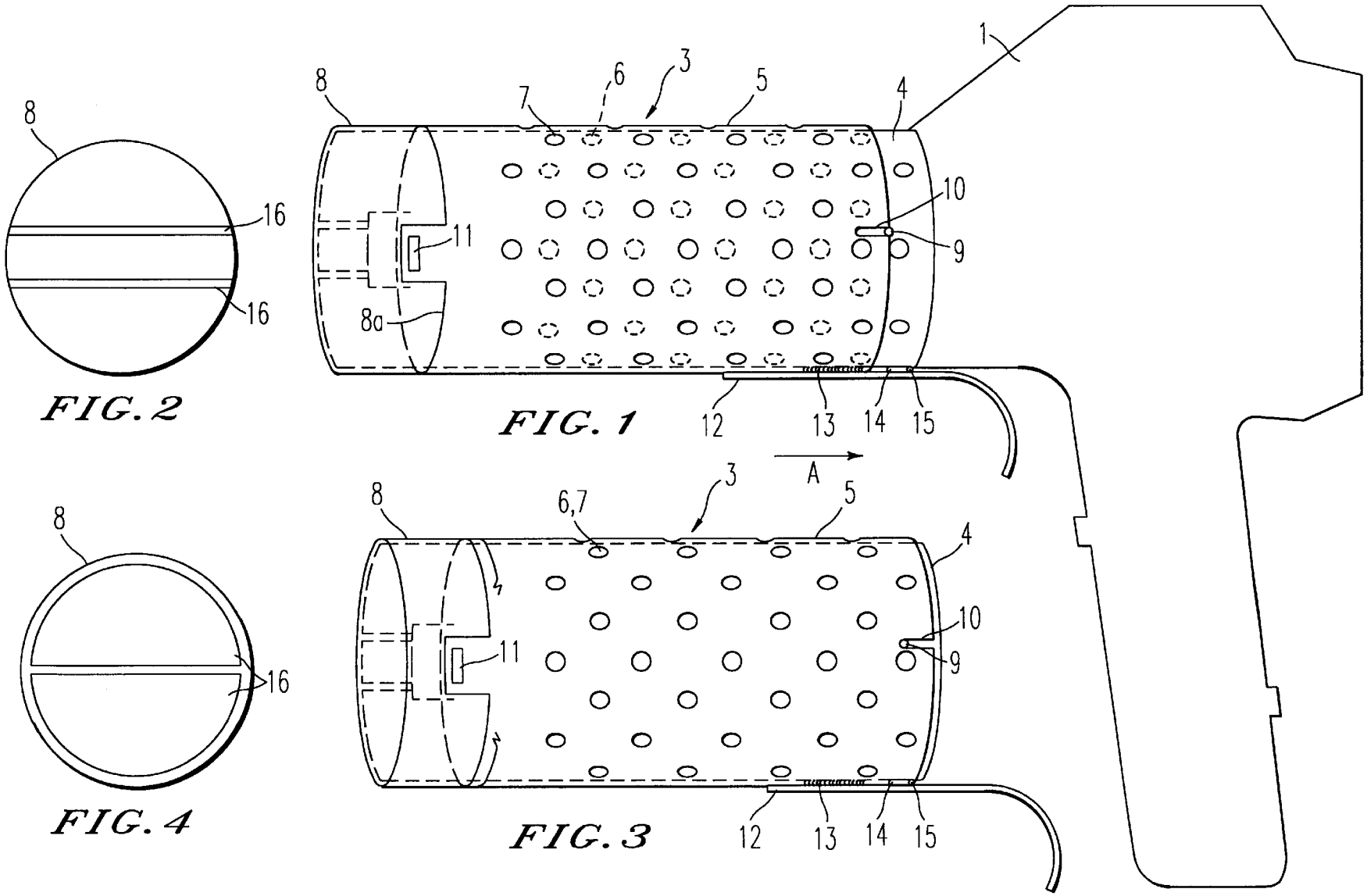
FIG. 1 is a view of the blow dryer and barrel assembly of the present invention in a first position in which the holes of the inner and outer cylinders of the barrel are not aligned.
FIG. 2 is a front view of the barrel opening of the blow dryer of FIG. 1 in the first position showing the flaps or deflecting means in an opened position.
FIG. 3 is a view of the inner and outer cylinders of the barrel of the blow dryer in a fully deflecting position in which the holes of the inner and outer cylinders are aligned.
FIG. 4 is a front view of the barrel opening when the inner and outer cylinders are aligned as shown in FIG. 3, in which the flaps or deflecting means substantially close the barrel opening.

Referring now to the drawings, wherein like reference numerals designate identical or corresponding parts throughout the several views, and more particularly to FIGS.

Figures 5, 6, 7, 8:
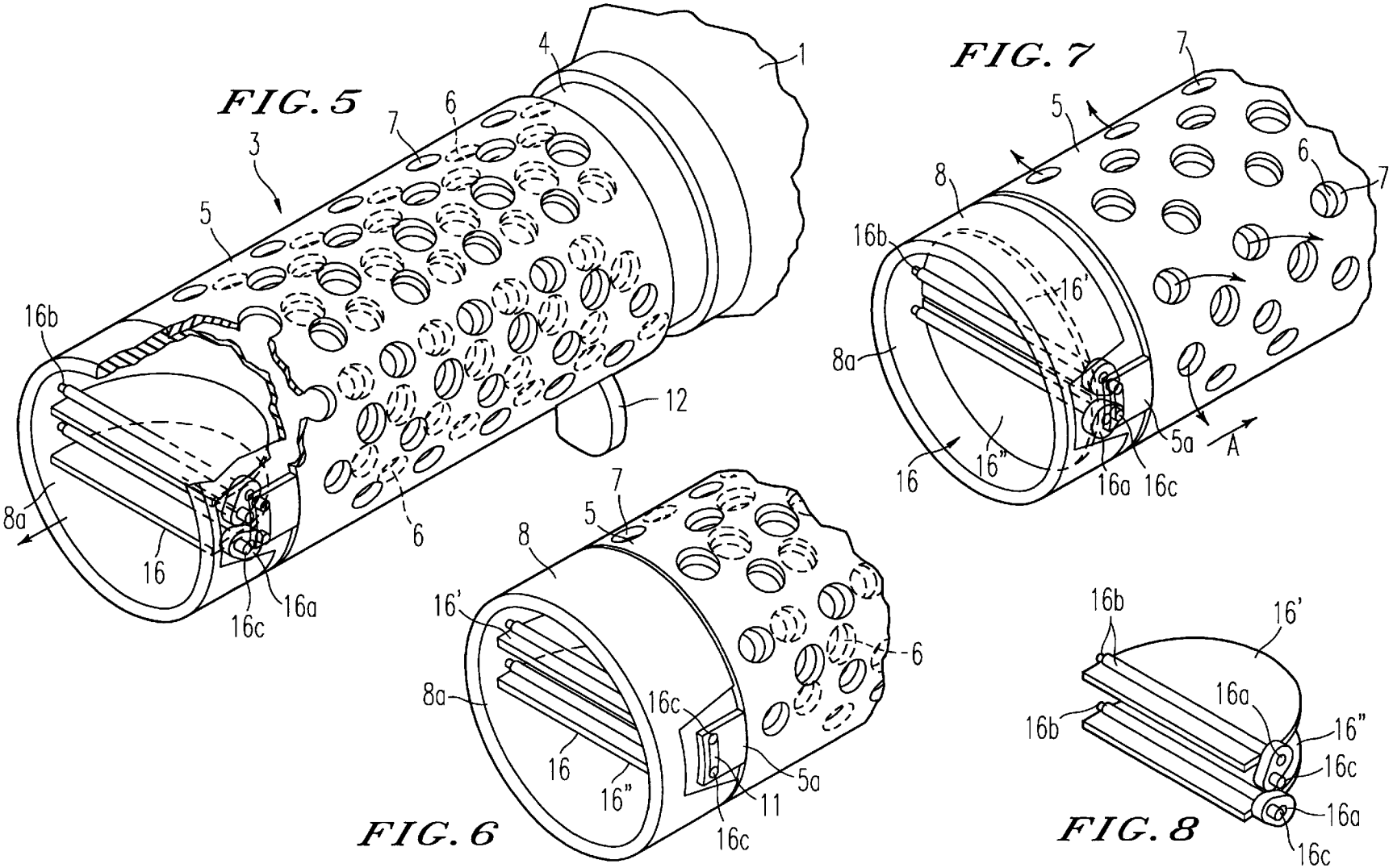
FIG. 5 is a perspective view of the inner and outer cylinders of the barrel and the flaps or deflecting means in the first position of FIGS. 1 and 2.
FIG. 6 is a perspective view of the flaps in an opened position as illustrated in FIG. 5.
FIG. 7 is a perspective view of the flaps and the inner and outer cylinders in the fully deflecting position of FIGS. 3 and 4.
FIG. 8 shows the flaps in isolation.

1 and 5 thereof, FIG. 1 is a first view of the blow dryer assembly of the present invention while FIG. 5 is a perspective view. In FIGS. 1 and 5, the blow dryer includes a body 1 having a barrel 3. The barrel 3 can include an inner cylinder 4 and an outer cylinder 5 concentric with the inner cylinder 4. The outer cylinder 5 is slidably mounted on the inner cylinder 4. Each of the inner and outer cylinders (4, 5) includes a plurality of holes (6, 7) thereon (holes 6 on inner cylinder 4 and holes 7 on outer cylinder 5).

As further illustrated in FIGS. 1 and 6, the blow dryer assembly can also include a cap 8 which covers a pivotable flap mechanism 16. The cap 8 and pivotable flap mechanism 16 are positioned at the barrel opening 8*a*. The cap 8 in FIG. 6 shows a cut-out opening, however, it is recognized that the cap 8 can completely cover all the moving mechanisms including the pivotable flap mechanism 16 at the front of the barrel. Applicant notes, however, that the present invention can be used without the cap 8 and the use of the cap 8 depends on design considerations.

FIGS. 1, 5 and 6 illustrate a first position of the outer cylinder 5 with respect to inner cylinder 4 in which the holes 7 on the outer cylinder 5 are not aligned with the holes 6 of the inner cylinder 4 and the pivotable flap mechanism 16 is in an opened position. Therefore, any air flow through the barrel 3 will flow out of the barrel opening 8*a*. The non-aligned holes 6 and 7 of the inner and outer cylinders 4, 5 will block any air flow through the surface of the barrel 3.

In the position illustrated in FIGS. 3 and 7 the inner and outer cylinders 4, 5 are aligned so as to align the respective holes 6, 7 of the inner and outer cylinders 4, 5. In the position illustrated in FIGS. 3 and 7, the flap mechanism 16 is positioned as illustrated in FIGS. 4 and 7. That is, the flap mechanism 16 is positioned in a fully deflecting position so as to substantially cover the barrel opening 8*a* as illustrated in FIGS. 4 and 7.

Figure 28:
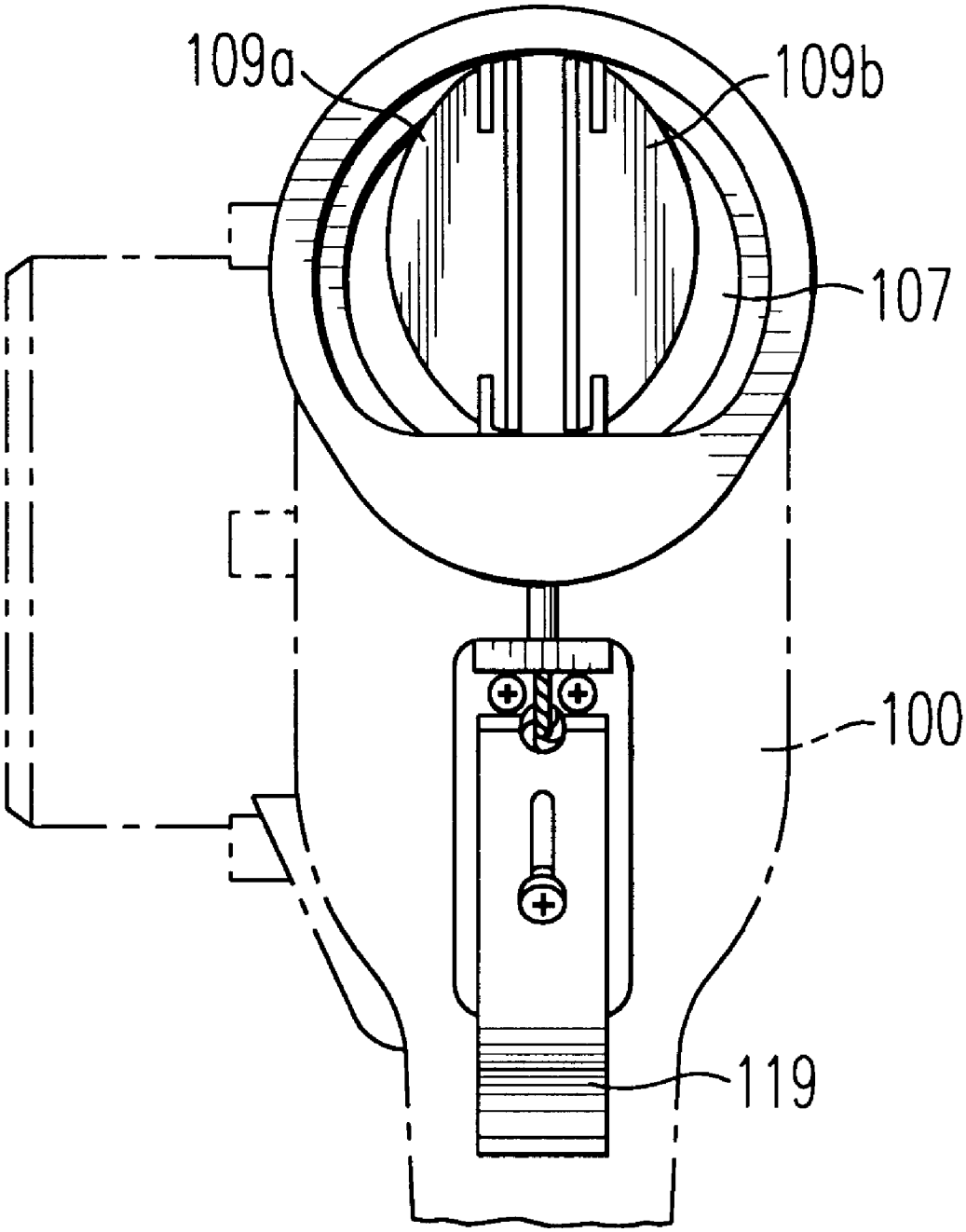
FIG. 28 is a front view of the barrel based on FIGS. 19 and 20.

It is noted that the movement of the inner and outer cylinders 4, 5 with respect to each other is coordinated with the movement of the flap mechanism 16 so as to achieve the positioning of the flap mechanism 16 as noted above. In this fully deflecting position (i.e., FIG. 7), the flap mechanism 16 will deflect most of the air flow so as to direct air flow to the aligned holes 6 and 7 of the inner and outer cylinders 4, 5. Thus, air will be discharged through the surface of the barrel 3. Therefore, by actuation of an actuator 12, a user can gradually, controllably or continuously cause the flap mechanism 16 to move from an open position to a substantially closed or fully deflecting position illustrated in, for example, FIG. 7. As a further option, by actuation of the actuator 12, the user can gradually, controllably or continuously cause the flap mechanism 16 to move from the open position, to one or a plurality of intermediate deflecting positions (an example of an intermediate deflecting position is shown in FIGS. 26 and 28) which permit a desired partial closing of the barrel opening 8*a*, to the final substantially closed position illustrated in, for example, FIG. 7.

In coordination with the moving of the actuator the outer cylinder 5 can move in the direction A to cause the holes 6, 7 of the inner and outer cylinders 4, 5 to go from the fully non-aligned position of FIG. 5, to a final position in which the holes 6, 7 become fully aligned with each other as illustrated in, for example, FIG. 7. As a further option, between the fully non-aligned position (FIG. 5) and the fully aligned position (FIG. 7), in coordination with the movement of the actuator, the outer cylinder 5 can be moved to one or a plurality of intermediate positions in which the holes 6, 7 are partially misaligned (see FIG. 26).

The actuator 12 can be continuously movable so as to be controllable by the user, or one or a plurality of stops for the actuator which correspond(s) to the above noted positions can be provided, as will be shown in greater detail below.

Figure 26:
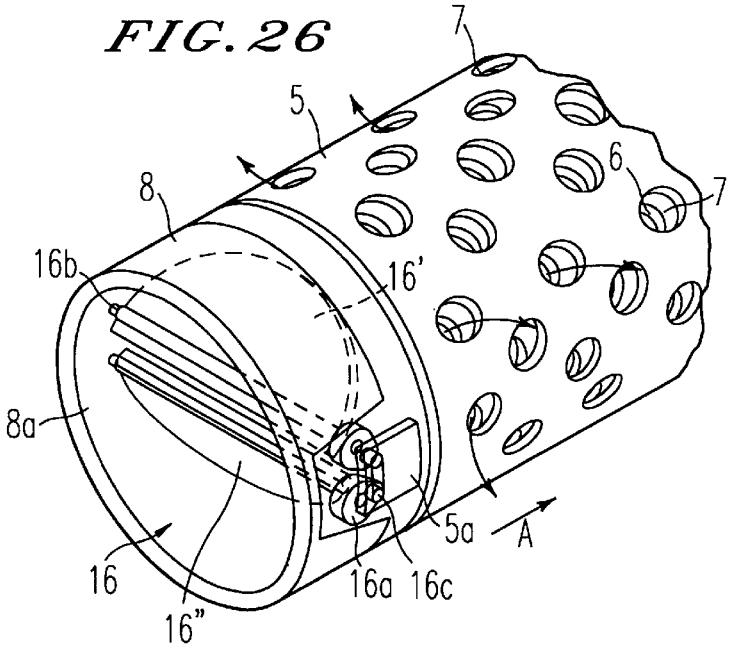
FIG. 26 is a further view of the barrel of the first embodiment.
Figure 35:
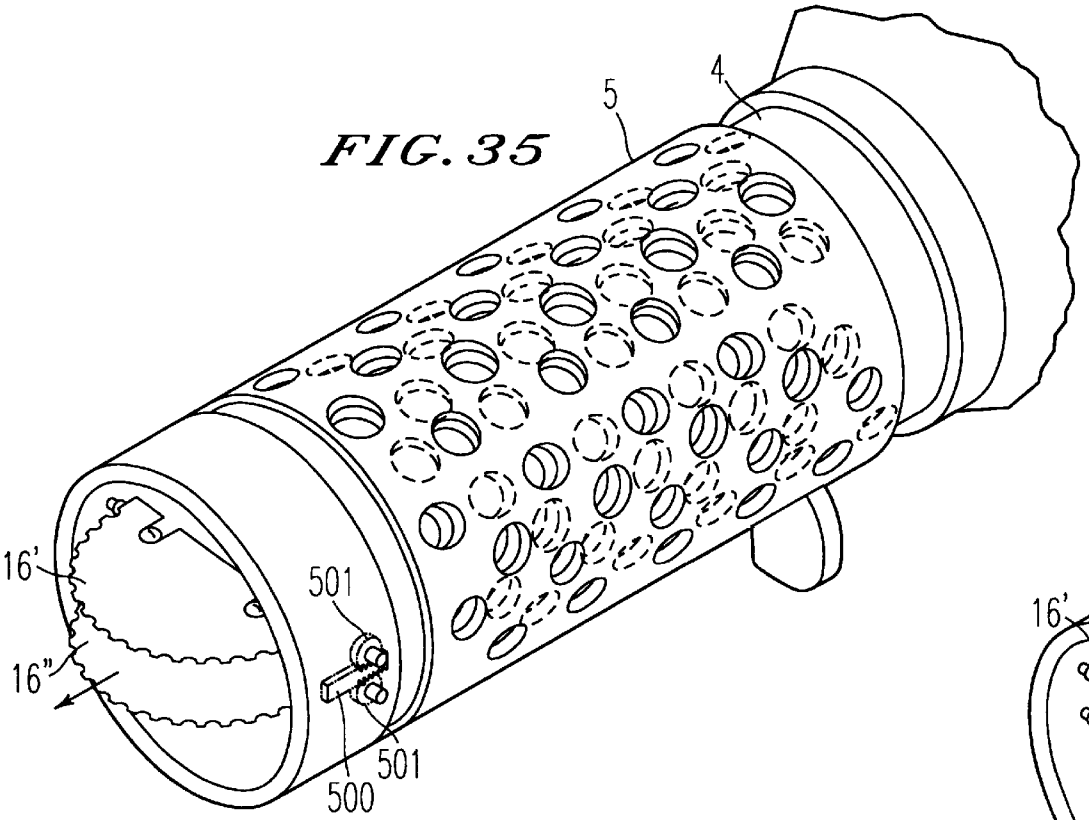
FIG. 35 shows the rack gear arrangement with the flaps open.

Also, FIG. 26 shows the upper flap 16' moving inma counter clockwise direction and the lower flap 16" moving in a clockwise direction. It is noted that the rotational movement of the flaps is not limited to the disclosed movements. It is recognized that based on the position of the flap mechanism 16 within barrel 3, the flaps can move either clockwise or counter-clockwise to achieve the desired opening and closing of the barrel opening (an example of a flap mechanism moving in a different direction is shown in FIG. 35). The same applies to FIG. 28 which shows an example of n intermediate position of the deflector 109. It is therefore recognized that the direction of rotation of the deflector is based on design considerations.

As a further embodiment, Applicant notes that actuation of the actuator 12 can first cause a movement of one of the outer or inner cylinders 5, 4, and thereafter a delayed movement of the flap mechanism 16 to the substantially closed position. This approach will permit some diffused air to escape through the barrel opening.

An example of a mechanism for achieving the above-noted movement of the inner and outer cylinders 4, 5 and the flap mechanism 16 will now be described. As illustrated in FIGS. 5–8, as well as FIGS. 9(*b*) and 11(*a*)–11(*c*), the pivotable flap mechanism 16 includes first and second flaps 16', 16" having mounting axles 16*b* and mounting pins 16*c* extending therefrom. The mounting pins 16*c* are mounted in an offset manner on an oval actuator 16*a* as illustrated in FIG. 8. The present invention can also utilize washers 16*d* (FIG. (9) and 11(*a*)–11(*c*)) at the mounting pins 16*c* to permit a smooth operation. The pivotable flap mechanism 16 with the mounting pins 16*c* are mounted within the barrel 3, substantially within the barrel 3, or at the barrel opening 8*a* as follows: the mounting axles 16*b* and pins 16*c* are mounted so as to be inserted into elongated slots 17 on the inner cylinder 4 and elongated slot 11 on the outer cylinder 5 (see FIG. 6, FIG. 9(*a*) and FIG. 10). The slot 11 on the outer cylinder 5 is positioned on a protruding portion 5*a* of the outer cylinder 5. Thus, a movement of the outer cylinder 5 in the direction of the arrow A (FIGS. 1 and 7) will cause a movement of the pivotable flap mechanism 16 from at least the position illustrated in FIG. 5 in which the barrel opening 8*a* is opened, to a position illustrated in FIG. 7 in which the barrel opening 8*a* is substantially closed, i.e., the fully deflecting position. This is due to the fact that the movement of the outer cylinder 5 in the direction A will cause the pins 16*c* of the pivotable flap mechanism 16 to rotate with the oval activator 16*a*, which will thereby cause the pivotable flap mechanism 16 to rotate to the substantially closed position.

Figure 10:
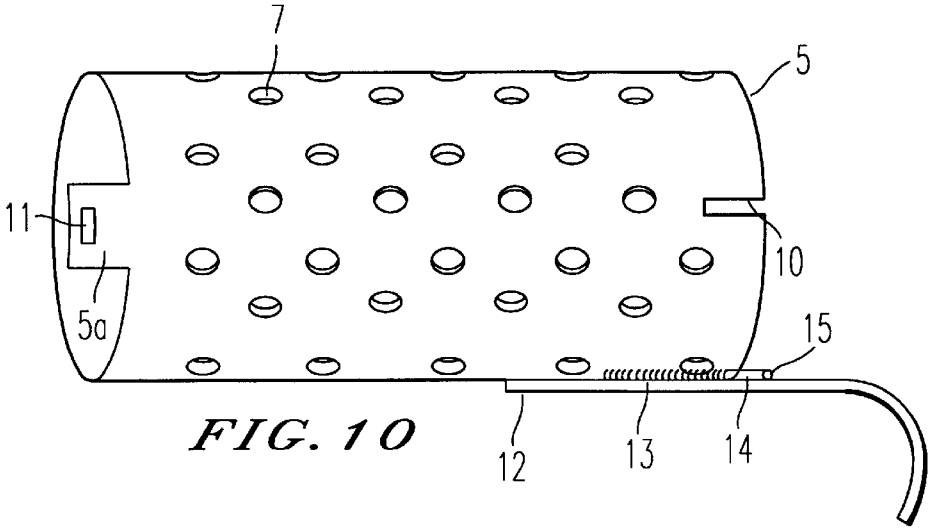
FIG. 10 shows the outer cylinder of the present invention.

The outer cylinder 5 can include the actuator such as, for example, the trigger 12 which is utilized to cause the sliding movement of the outer cylinder 5 with respect to the inner cylinder 4. The actuator or trigger 12 includes a spring 13 positioned in a slot 15 in the outer cylinder 5 which is guided by a pin 14 (FIGS. 1, 3, 10). The spring 13 urges the outer cylinder 5 in a direction opposite to direction A. Actuation of the actuator, such as, for example, pulling the trigger 12 in the direction A will cause the outer cylinder 5 to move in direction A which thereby causes the movement of the pivotable flap mechanism 16 from at least the position illustrated in FIG. 5 to the substantially closed position illustrated in FIG. 7. FIGS. 1, 3 and 10 show a single spring 13 positioned on a lower portion of the barrel assembly 3. It is noted, however, that the barrel assembly can also include two springs 13 positioned on diametrically opposed portions of the barrel assembly 3 to add stability to movement of the cylinders (4, 5).

At the same time or approximately at the same time, movement of the outer cylinder 5 in the direction A will also cause the holes 6, 7 of the inner and outer cylinders 4, 5 to become aligned with each other as illustrated in FIG. 7.

Therefore, in a first position (first mode) illustrated in FIGS. 1 and 5, the pivotable flap mechanism 16 is in the position illustrated in FIG. 5 to permit airflow through the barrel opening 8*a* and the holes on the inner and outer cylinders 4, 5 are not aligned (FIGS. 1 and 5) so as to block airflow through the surface of the barrel 3. This permits the user to use the blow dryer in a normal manner.

When the user desires to utilize the blow dryer for horizontal lifting/drying, styling, as a hot roller, as a diffuser, etc., the user actuates the actuator, for example, pulls the trigger 12 in the direction A to position the outer cylinder 5 with respect to inner cylinder 4 in the manner illustrated in FIGS. 3 and 7 (final mode or fully deflecting position). This will cause the holes 6, 7 on the inner and outer cylinders 4, 5 to become aligned, and will cause the flaps 16', 16" of the flap mechanism 16 to gradually pivot to the position illustrated in FIG. 7 to substantially close the barrel opening 8*a*. In this position, the flaps 16', 16" will deflect air towards the aligned holes 6, 7 exposed on the barrel, and some diffused air will flow through the barrel opening 8*a*. In a further feature of the present invention, the user can move the actuator 12 to intermediate positions which causes the flap mechanism 16 to controllably move through intermediate deflecting positions (one is shown in FIG. 26), and also causes the movement of one of the inner or outer cylinders 4, 5 to intermediate positions in which the holes 6, 7 are partially aligned (FIG. 26) so that a partial deflection will cause a desired air flow through the partially aligned holes 6, 7. Therefore, the use of intermediate positions of the actuator 12 can permit the user to finely control the amount of deflection by the flap mechanism 16 as well as the aligning positioning of the holes 6, 7.

It is recognized that the present invention is not limited to described arrangement for movement of the flap mechanism and cylinders, and any device such as, for example, gears which can achieve the desired movements noted above can be utilized, as will be shown in greater detail below.

Figure 9A:
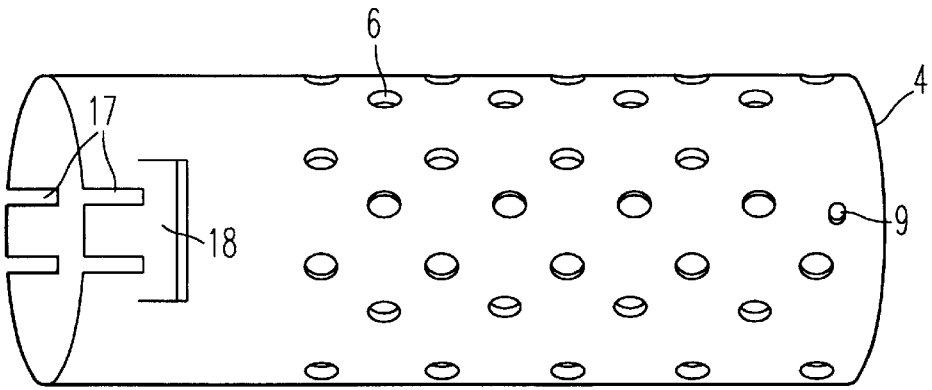
FIGS. 9(*a*), 9(*b*) and 9(*c*) respectively show the inner cylinder, flaps, and a cap for the barrel.
Figure 9B:
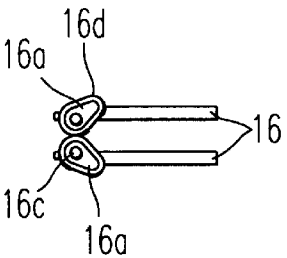
Figure 9C:
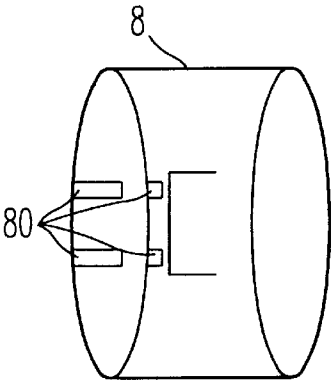

The amount of movement of the outer cylinder 5 with respect to the inner cylinder 4 can be determined by providing for an elongated slot 10 on the outer cylinder 5 and a pin 9 on the inner cylinder 4 as illustrated in FIGS. 1, 3, 9(*a*) and 10. When the barrel opening 8*a* is substantially closed by the flaps 16', 16" as illustrated in FIG. 7, the barrel opening 8*a* is not sealed tightly by the flaps 16', 16" so as to permit some air to be diffused from the barrel opening.

The present invention can also provide for the cap 8 illustrated in FIGS. 6 and 9(*c*) which can be utilized to cover the flap mechanism 16. The cap 8 shows a cut-away portion to illustrate the side of the flap mechanism 16. It is recognized that the cap 8 can completely surround the circumferential front of the barrel. The cap 8 also can include stops 80 (FIG. 9(*c*)) such that the cap 8 fits over the outer cylinder 5 and includes cooperating holes which permit the insertion of the axles 16*b* and pins 16*c* of the flap mechanism 16.

Figure 37:
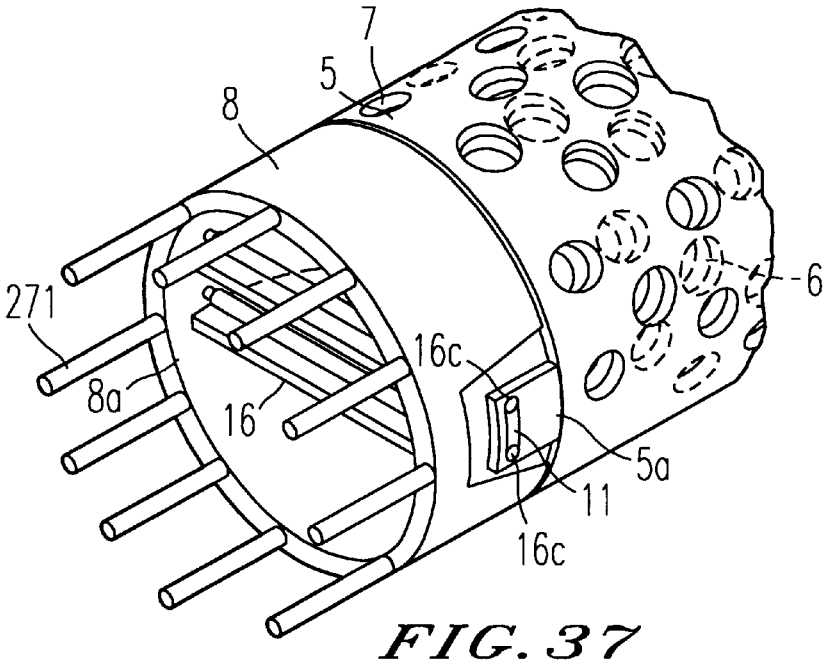
FIG. 37 shows projections on the peripheral surface of the cap adjacent to the barrel opening.

FIG. 37 shows a further embodiment of the cap 8 in which the outer peripheral surface near the barrel opening 8*a* can include a plurality of projections such as bristles or teeth 271. The teeth 271 can be utilized to guide hair and for further styling enhancements or massage. The modified cap 8 allows the user to either use a cap with or without teeth 271 by simply removing one cap and replacing it with another cap.

Figure 38A:
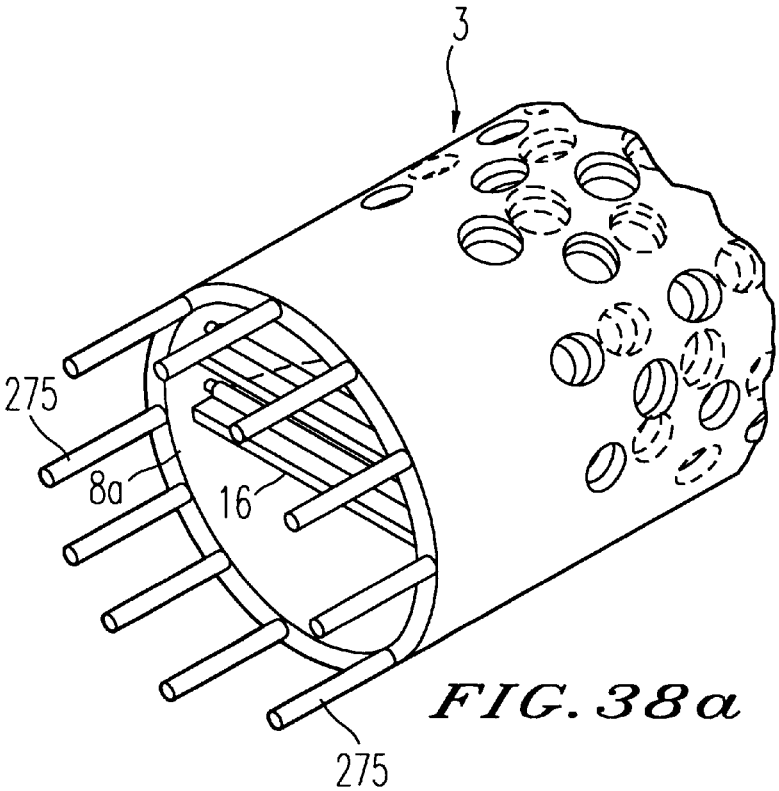
FIGS. 38*a*–38*c* show projections on the peripheral surface of the barrel adjacent to the barrel opening, and attachments having peripheral projections.

FIG. 38*a* a shows a further embodiment of the barrel 3 in which the outer peripheral surface near the barrel opening 8*a* can include a plurality of projections such as bristles or teeth 275. Again, the teeth 275 can be utilized to guide hair and for further styling enhancements or massage.

Figure 38B:
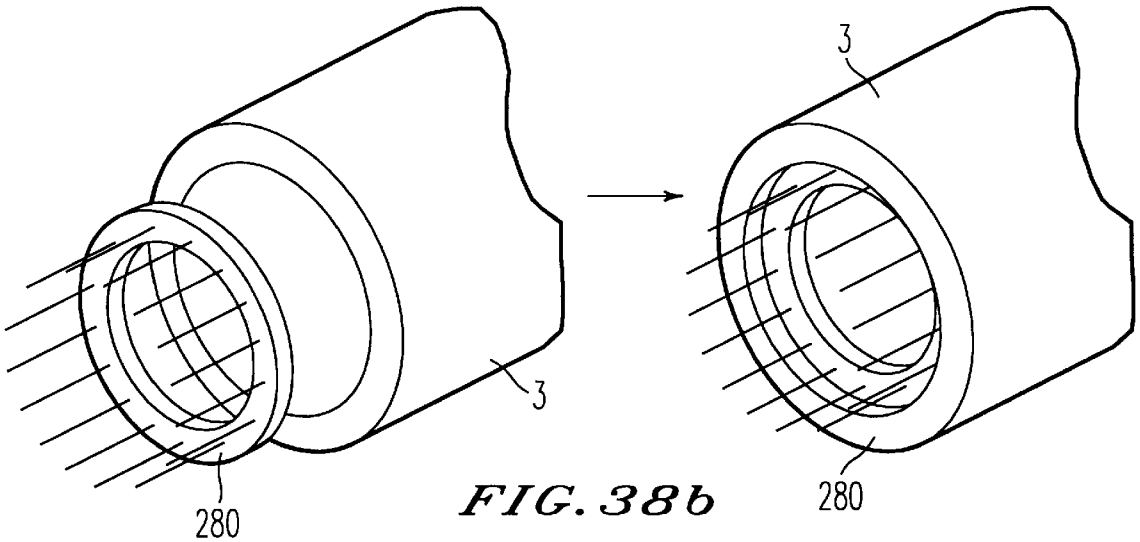
Figure 38C:
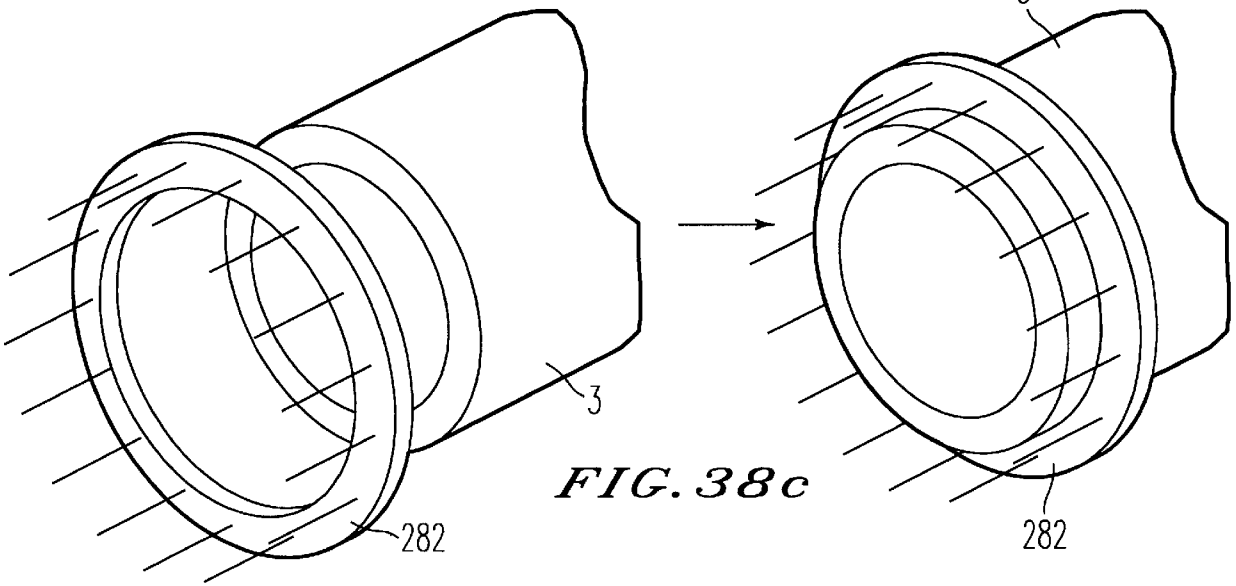

Furthermore, the plurality of projections can be provided as an inside barrel attachment 280 as shown in FIG. 38*b* which is press fitted into the barrel near the barrel opening, or as an outside barrel attachment 282 as shown in FIG. 38*c* which slips around the outside of the barrel near the barrel opening. These enhancements of inside and outside barrel attachments having projections 280, 282 and the cap 8 having projections such as bristles or teeth 271 can be utilized in any of the embodiments discussed in this specification including the embodiment with a single barrel 103 or the embodiment which includes the inner and outer barrels.

Figure 12:
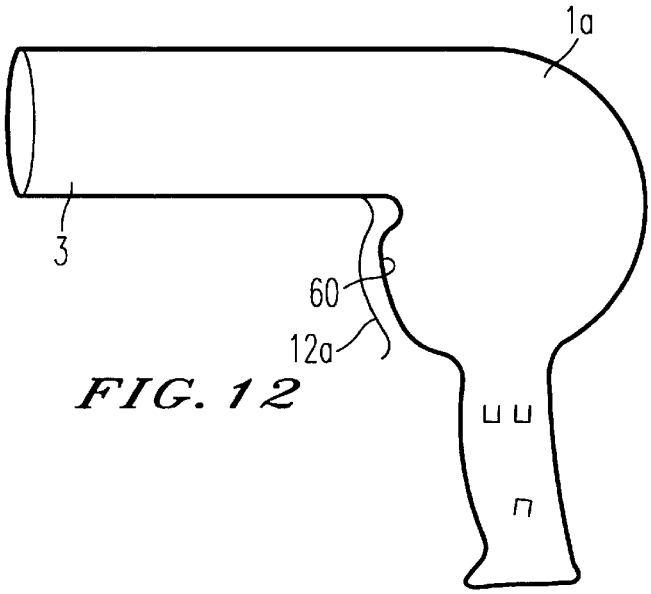
FIG. 12 shows a different blow dryer body embodiment.

The blow dryer arrangement of the present invention can also be utilized on a blow dryer 1*a* having a belly type curve 60 in the motor housing as illustrated in FIG. 12 or any other type of body. In the case of a belly type body, the actuator or trigger 12*a* would have a curve which matches the curve of the housing. This embodiment would operate in the same manner as the embodiment discussed above.

Additionally, the actuator or trigger 12 of the present invention can be operationally associated with a control mechanism 50 (FIG. 13) which coordinates the actuation of the trigger 12 with temperature settings of a blow dryer. For example, a conventional blow dryer can include low, medium and high settings. The trigger mechanism 12 of the present invention can be operationally associated with a control mechanism 50 such as illustrated in FIG. 13 to lower a high temperature setting of a blow dryer to a temperature setting which is lower than the high temperature setting when the trigger 12 is actuated (one way of actuating the temperature setting using the trigger is shown in FIGS. 39*a* and 39*b*).

Figure 13:
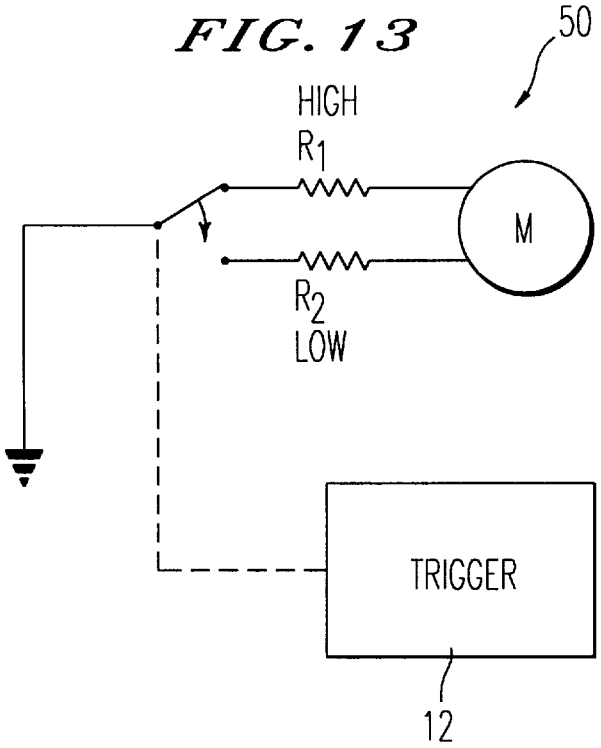
FIG. 13 shows a circuit arrangement for controlling temperature settings for the blow dryer of the present invention.

As illustrated in FIG. 13, the positioning of the actuator or trigger 12 in the first position (FIGS. 1 and 5) in which the holes 6, 7 are not aligned and the air flow is through the front opening 8*a* of the barrel can permit the hair dryer setting to be set at the high temperature setting ($R_1$) of a blow dryer. Movement of the actuator or trigger 12 to the fully deflecting or final position (FIGS. 3 and 7) in which the holes 6, 7 are aligned and the front opening 8*a* is substantially closed, can cause the dryer setting to be positioned in a temperature setting ($R_2$) which is lower than the high temperature setting of a blow dryer. The explanation given above has been given for the situation when the blow dryer is in the high temperature setting when the actuator or trigger is fully actuated. It is recognized that the control mechanism 50 can be designed so as to not lower the temperature if upon the actuation of the trigger 12 or 119, the blow dryer is set at the medium or low temperature settings. However, the lowering of the temperature setting of the blow dryer when the trigger 12 or 119 is actuated, is based on design considerations and the desired temperature which would be preferable when the actuator or trigger 12 or 119 is actuated. It is further recognized that the blow dryer could include an additional actuator or trigger mechanism which is not associated with the actuation of the actuator or trigger 12 so as to permit the user to selectively lower the temperature from a high temperature to a temperature lower than the high temperature. The control mechanism 50 can be utilized on the single barrel embodiment as well as any of the other disclosed embodiments.

Figure 39B:
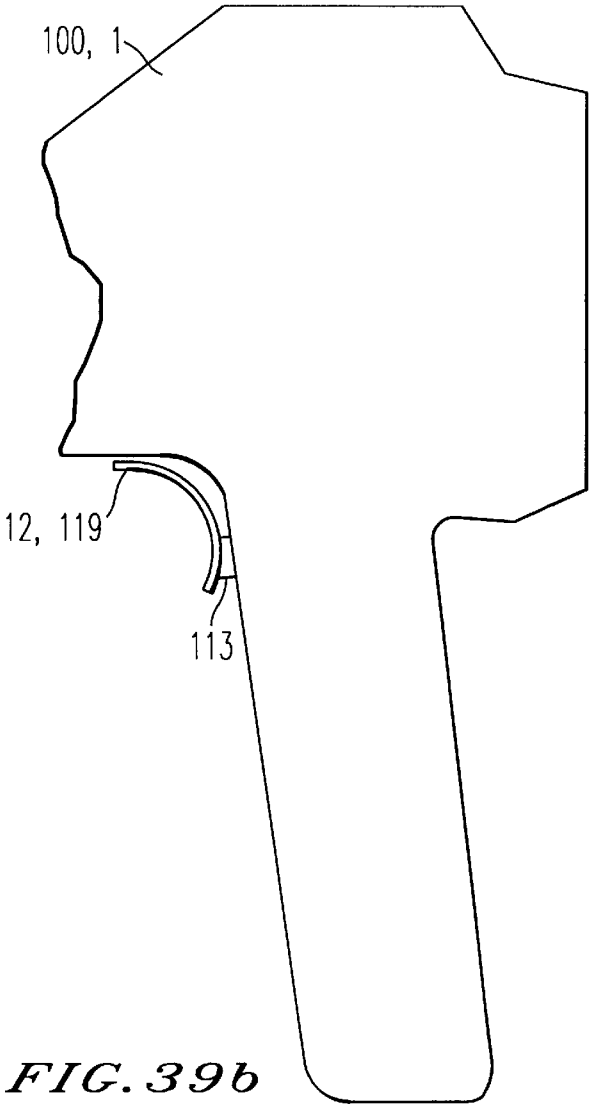
FIGS. 39*a*–39*b* show the depression of a switch.
Figure 39A:
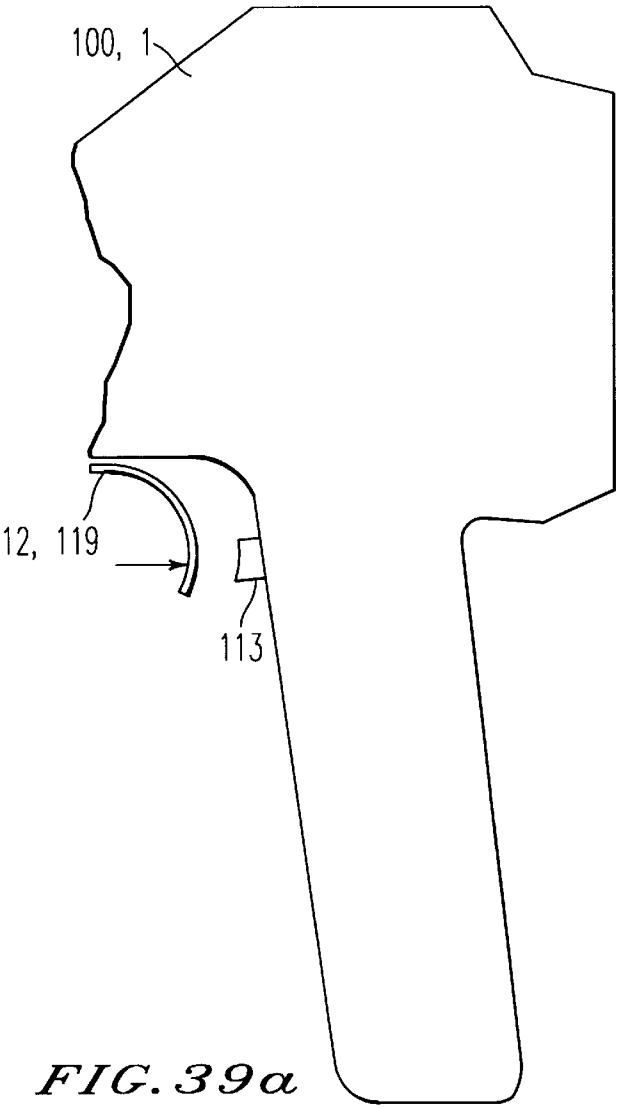

FIGS. 39*a* and 39*b* show a further embodiment of the temperature setting described above. FIG. 39*a* shows a partial cross-sectional view of the blow dryer body, actuator 12 or 119 and switch 113. As shown in FIG. 39*b* when the trigger mechanism 12 or 119 is moved to the fully deflecting position the temperature setting is decreased by depressing the switch 113, which is also shown schematically in FIG. 13. Furthermore, based upon design considerations, either one of the low temperature setting ($R_2$) or the high temperature setting ($R_1$) of a blow dryer can be located adjacent to the barrel opening 8*a* while the remaining temperature setting ($R_1$ or $R_2$) is located further away from the barrel opening 8*a*. The orientation of the temperature control mechanism 50 can be utilized with any of the disclosed embodiments.

Figure 14:
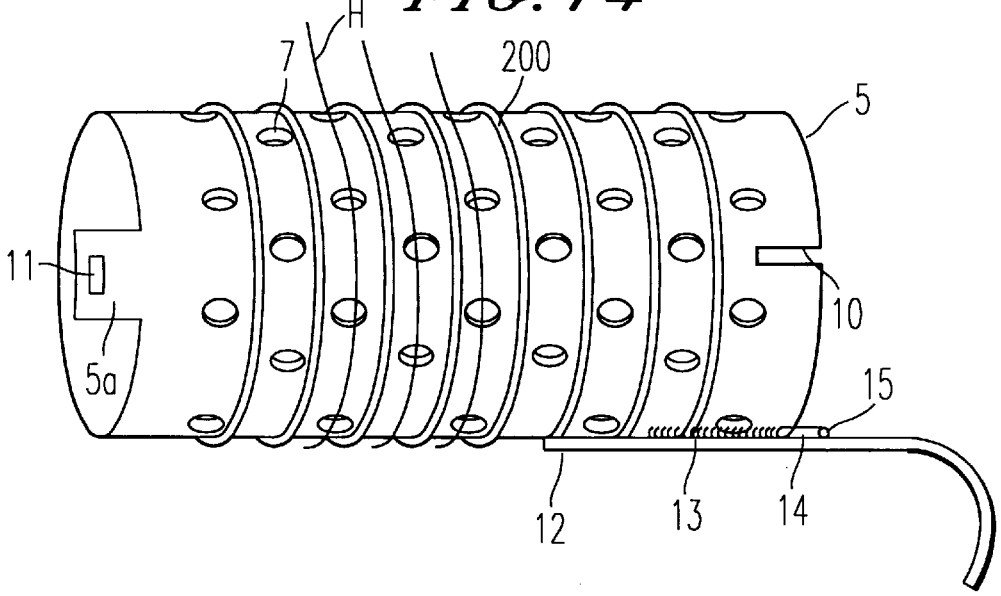
FIG. 14 shows a modification of the outer cylinder of the present invention.

FIG. 14 shows a further embodiment of the outer cylinder 5 of the barrel 3 in which the outer cylinder 5 includes rings 200 that are spaced along the length of the outer cylinder 5, are affixed to the periphery of the outer cylinder 5 and extend around the circumference of the outer cylinder 5. The rings 200 serve to guide hair H when the barrel assembly is positioned against hair. The rings 200 are aligned so as to not obstruct air flow from the holes (6, 7). These rings 200 can be utilized on any of the disclosed embodiments.

Figure 40:
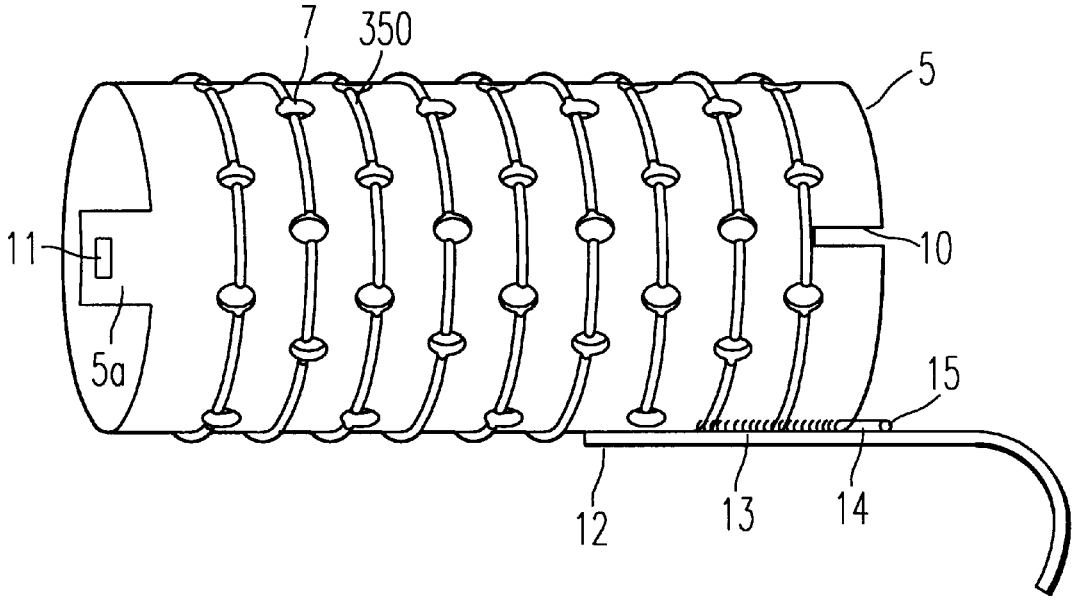
FIG. 40 shows another modification of the outer cylinder.

FIG. 40 shows a further embodiment of the outer cylinder 5 of the barrel 3 in which the outer cylinder 5 includes rings 350 that are spaced along the length of the outer cylinder 5, are affixed to the periphery of the outer cylinder 5 and extend around the circumference of the outer cylinder 5. The rings 350 serve to guide hair when the barrel assembly is positioned against the hair. The rings 350 are aligned so as to cross over the holes 7 so as to partially obstruct or divert the air flow creating a more diffuse airflow. The portion of the rings 350 directly over the holes 7 are carved-out in a concave shape to permit air deflection. These rings 350 can be utilized on any of the disclosed embodiments.

Figure 41:
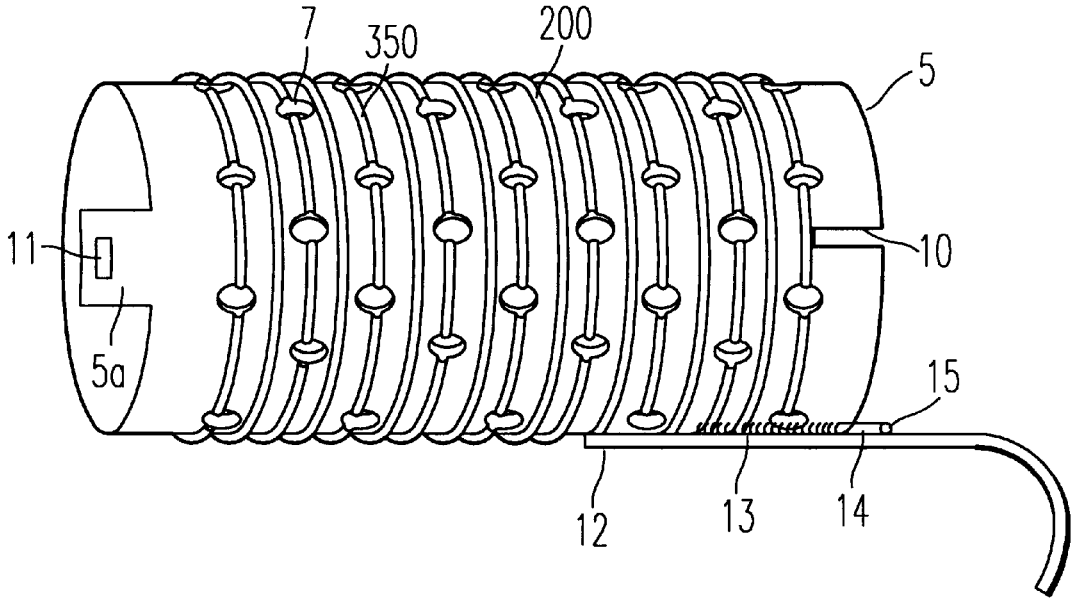
FIG. 41 shows still a further modification of the outer cylinder.

FIG. 41 shows a further embodiment of the outer cylinder 5 of the barrel 3 in which the outer cylinder 5 includes rings 200 and rings 350, of the two embodiments described above, that are spaced along the length of the outer cylinder 5 and extend around the circumference of the outer cylinder 5. The rings 200 and 350 serve to guide hair when the barrel assembly is positioned against hair. These rings 200, 350 can be utilized on any of the disclosed embodiments.

Figure 15:
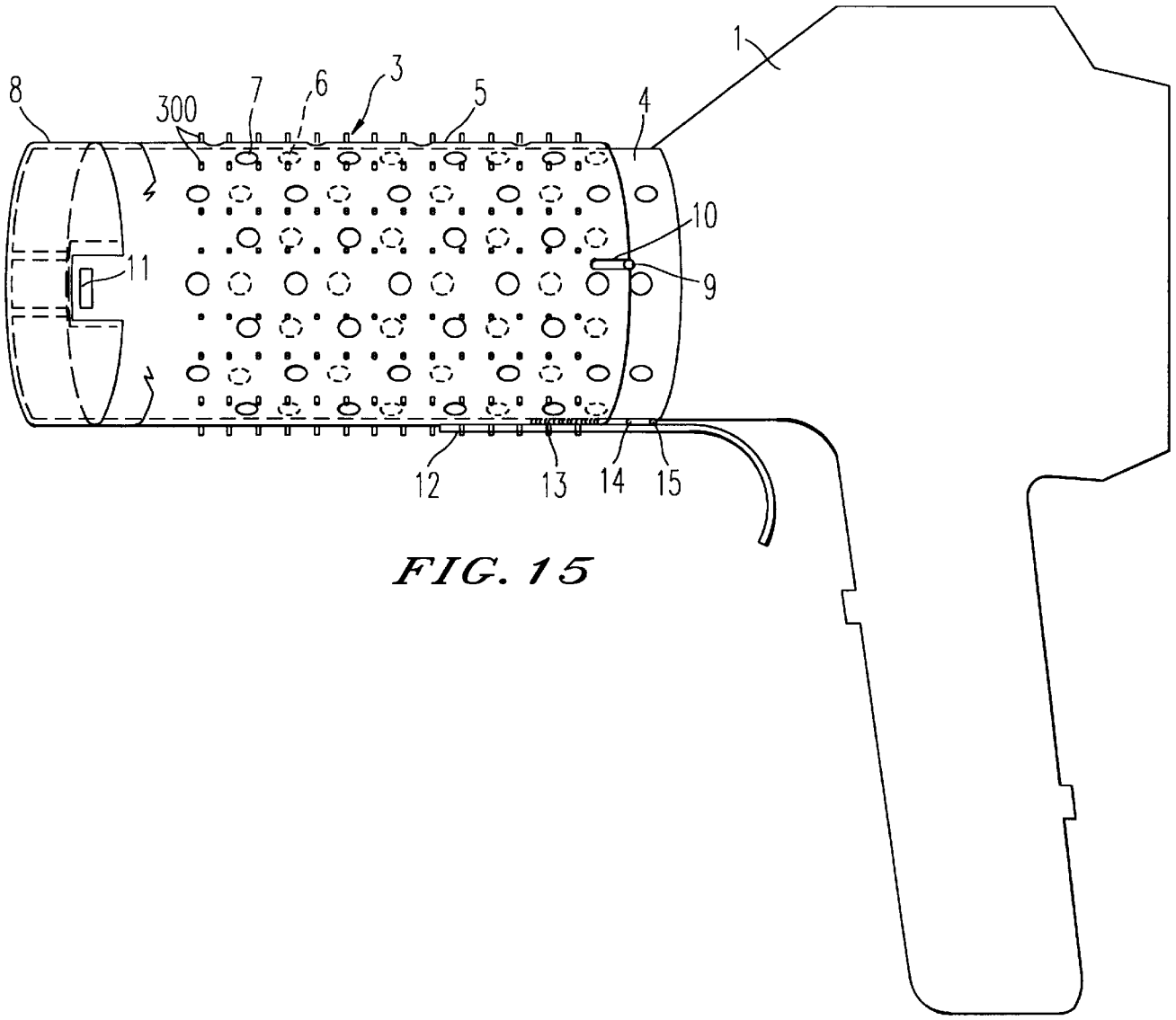
FIG. 15 shows a further modification of the blow dryer of the present invention.

FIG. 15 shows a further embodiment of the barrel 3 in which the outer cylinder 5 of the barrel 3 can include projections such as bristles or teeth 300 spaced between the holes 7 of the barrel as illustrated in the figure, so as to extend in a row between the holes 7. The bristles or teeth 300 can extend around the periphery of the outer cylinder 5 of the barrel 3 and can be utilized to guide hair and for further styling enhancement. These projections 300 like the rings 200 can be utilized on any of the disclosed embodiments.

Figure 16:
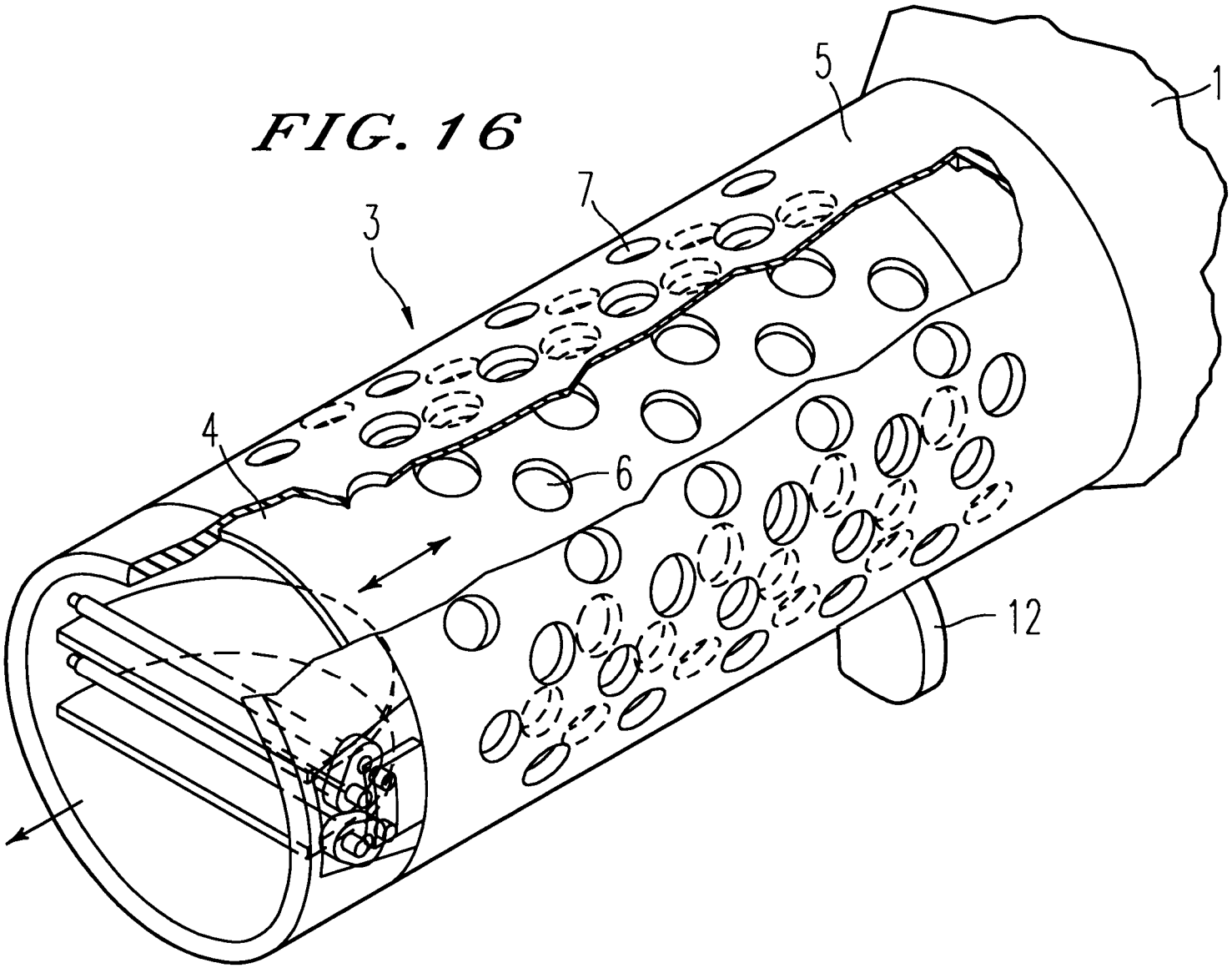
FIG. 16 is a further modification of the barrel of the blow dryer of the present invention.

FIG. 1 shows the actuator being operationally connected to the outer cylinder of the barrel such that the outer cylinder is slidable with respect to the inner cylinder. However, the invention is not limited to this arrangement and Applicant notes that as a further embodiment, the inner cylinder 4 can slidably move within the outer cylinder 5 (FIG. 16). In this embodiment, the outer cylinder 5 would be fixed or integral to the body 1. With this arrangement, the inner cylinder 4 can be operationally connected to the actuator 12 so as to be slidable with respect to the outer cylinder 5. With respect to the remaining features of the invention, this arrangement would work in a similar manner as described above with respect to the first embodiment.

Figure 17:
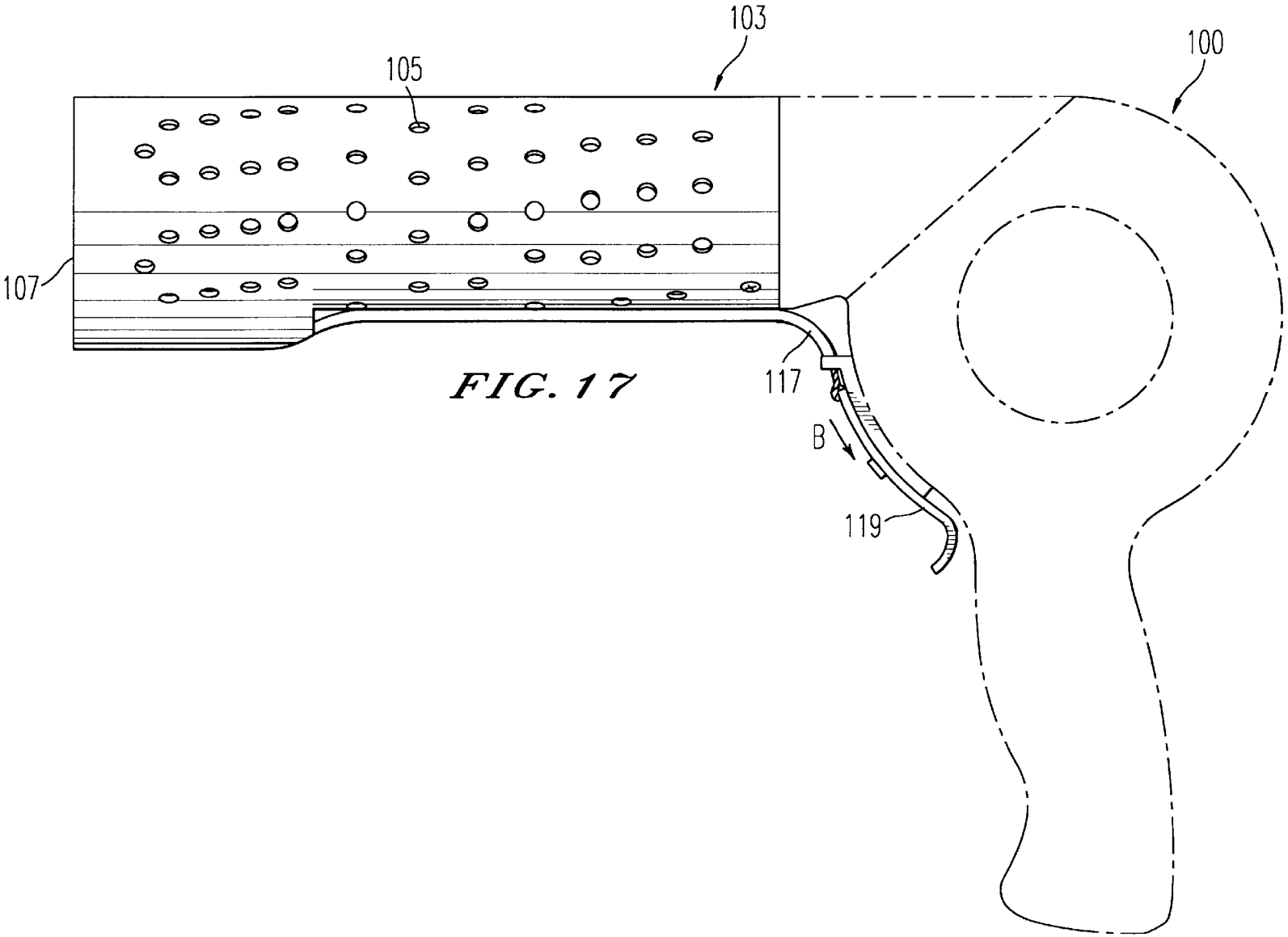
FIG. 17 shows a further embodiment of the blow dryer of the present invention in which the body of the blow dryer includes a barrel with a plurality of holes and deflector.
Figures 18, 19, 20:
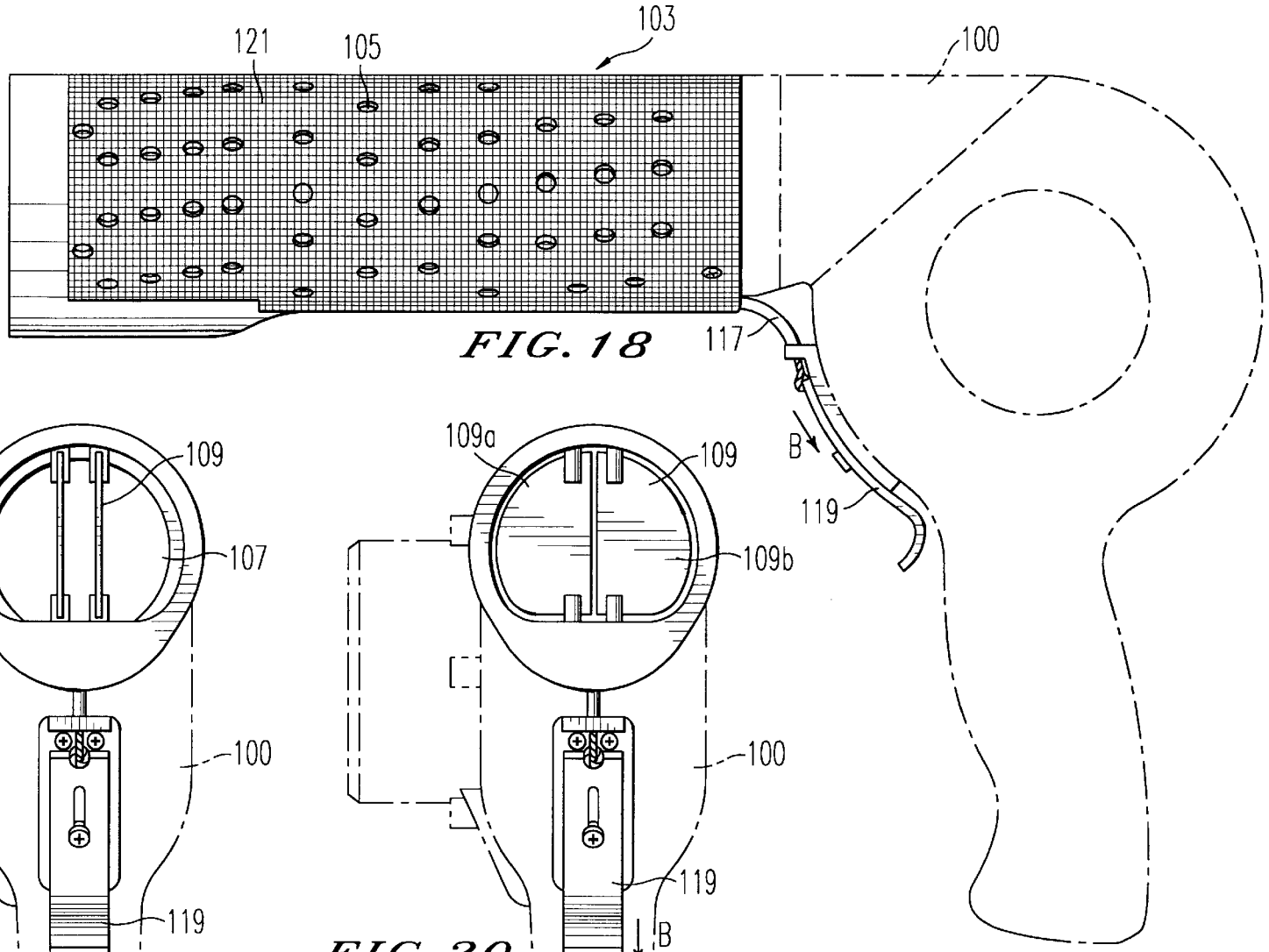
FIG. 18 illustrates a further variation of the blow dryer of FIG. 17 in which the blow dryer includes a mesh-type screen surrounding the barrel.
FIG. 19 is a front view of the blow dryer of the present invention in which deflector is in an open position.
FIG. 20 is a front view of the blow dryer of the present invention in which the deflector is in a final closed position or a fully deflecting position.

FIG. 17 illustrates a further embodiment of the blow dryer of the present invention. In FIG. 17, the body 100 can be similar to the body 1 illustrated in the previous embodiments. The embodiment of FIG. 17 includes a barrel 103 which is fixed or integral to the body 100 and has a plurality of holes 105. A deflector 109 can be positioned within the barrel 103 or substantially within the barrel 103. As an example, the deflector 109 can be positioned at an opening 107 of the barrel 103, as illustrated in FIGS. 19 and 20. The deflector 109 can be arranged as illustrated in the previous embodiments or can be a vertically arranged deflector as illustrated in FIGS. 19 and 20. Applicant notes, however, that the orientation of the deflector 109 is not limited to the horizontal or vertical arrangements shown, and can be oriented in any manner within the barrel 103.

Figure 25A:
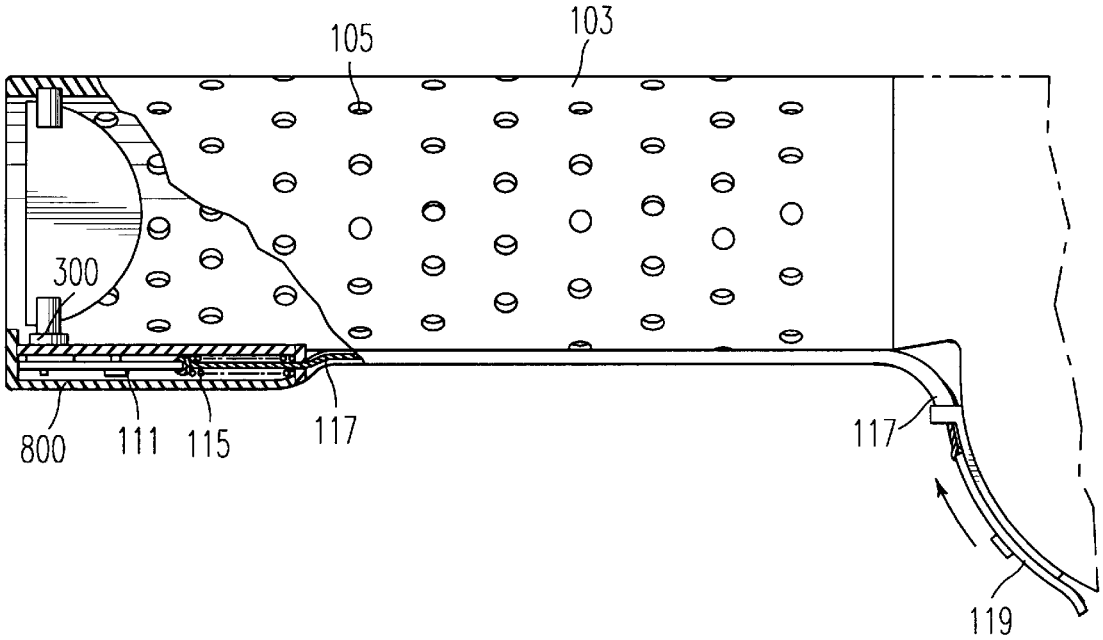
FIGS. 25(*a*) and 25(*b*) are side views of an embodiment of the blow dryer of the present invention illustrating a mechanism for actuating the deflector mechanism.
Figure 25B:
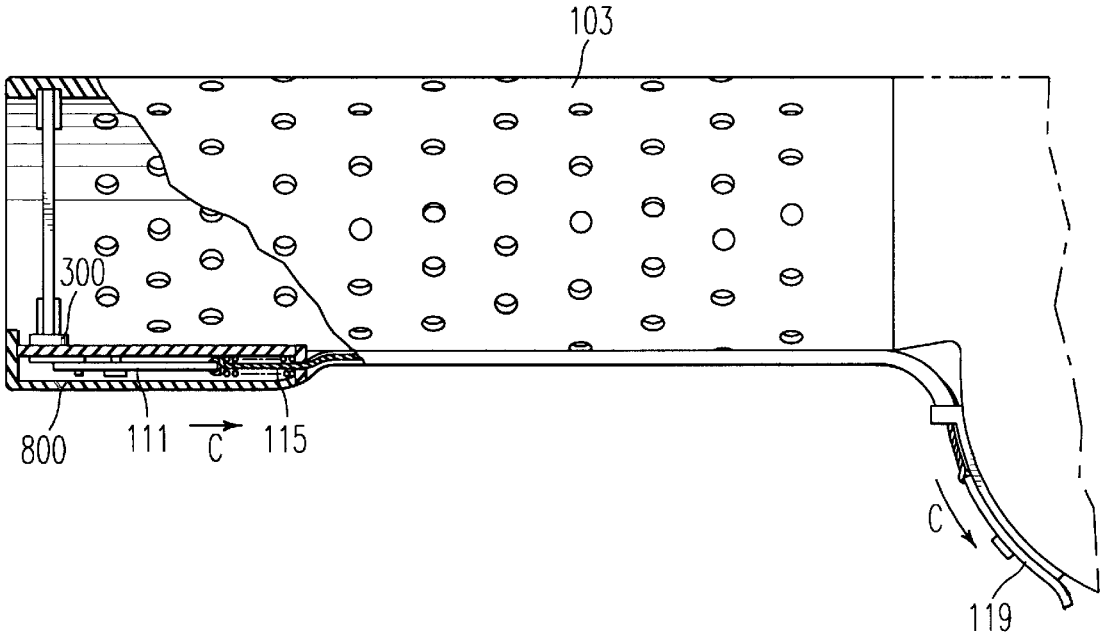
Figure 27:
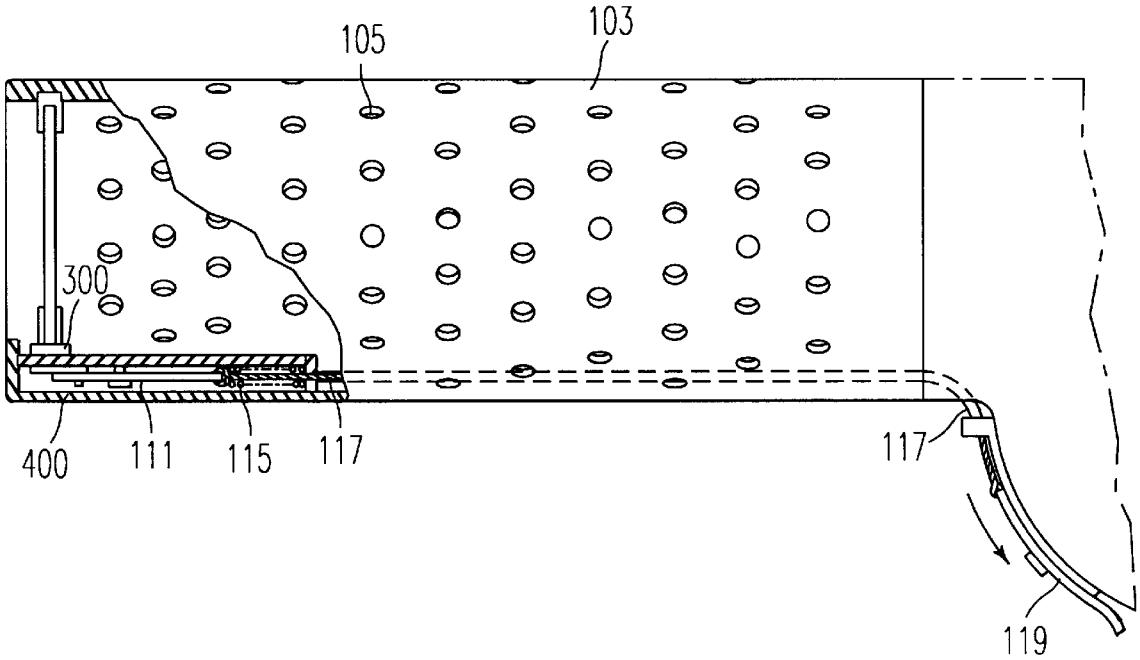
FIG. 27 is a side view illustrating a further variation of the barrel.

The deflector 109 of FIGS. 19 and 20 includes flaps 109*a*, 109*b*, and a plate member 111 and spring arrangement 115 (FIGS. 25(*a*), 25(*b*)) which maintains the deflector 109 in the open position illustrated in FIGS. 19 and 25(*a*). Attached to the plate member 111 is a connecting member 117 which extends along the barrel 103 to an actuator 119 on the barrel 103 or on the body 100. Although the figures show the connecting member 117 outside the barrel 103, as shown in FIG. 27, it is recognized that the connecting member 117 can be contained within the barrel 103.

Actuation of the actuator 119 in direction B causes the plate member 111 to move in direction C (FIG. 25(*b*)) to cause a gradual pivoting or rotation of the flaps 109*a*, 109*b* about pivot point 320. This causes a movement of the deflector mechanism 109 from at least the open position illustrated in FIGS. 19 and 25(*a*) to the substantially closed, or fully deflecting, position of FIGS. 20 and 25(*b*). As previously explained, it is further recognized that the actuator 119 can be adapted so as to move the deflector 109 to different intermediate deflecting positions (one is shown in FIG. 28) between the open and substantially closed position depending on the desired air flow and design considerations.

Although the plate member 111 and spring arrangement 115 are shown in an expanded portion 800 (shown in FIGS. 25*a* and 25*b*) of the barrel 103, this configuration is shown for illustrative purposes and clarity. It is recognized that the plate member 111, the spring 115 and the connecting member 117 can be arranged or contained within the barrel 103 so as to provide for a continuous and straight barrel as illustrated in FIGS. 1, 16, 27 and 28, where the plate member 111 and the spring arrangement 115 are shown in region 400 of FIG. 27.

With the embodiment illustrated in FIG. 17, during a normal blow drying operation, the deflector 109 is in the open position (FIG. 19) and air travels through the opening 107 of the barrel 103. The provision of the holes 105 along the barrel 103 permit some amount of air to flow through the holes 105, but not enough to disrupt the conventional or normal blow drying operation.

When the user desires to utilize the blow dryer for horizontal lifting/drying, styling, as a hot roller, as a diffuser, etc., the user actuates the actuator 119 in the direction B to gradually and substantially close the barrel opening 107 with the deflector 109. The deflector 109 will therefore deflect and ultimately force most of the air flowing through the barrel 103 out of the holes 105 on the barrel 103 so that the blow dryer can be utilized for horizontal lifting/drying, etc.

As the deflector 109 is being actuated to the substantially closed, or fully deflecting, position, depending on the preference of the user it can further variably deflect air in intermediate deflecting positions between the open position and the substantially closed, or fully deflecting, position of the deflector. In this embodiment, the actuator 119 can be modified to provide for several stop positions which correspond to the intermediate positions of the deflector 109. However, the actuator 119 can also be freely and continuously movable to permit the user to control the amount of deflection.

Figure 23:
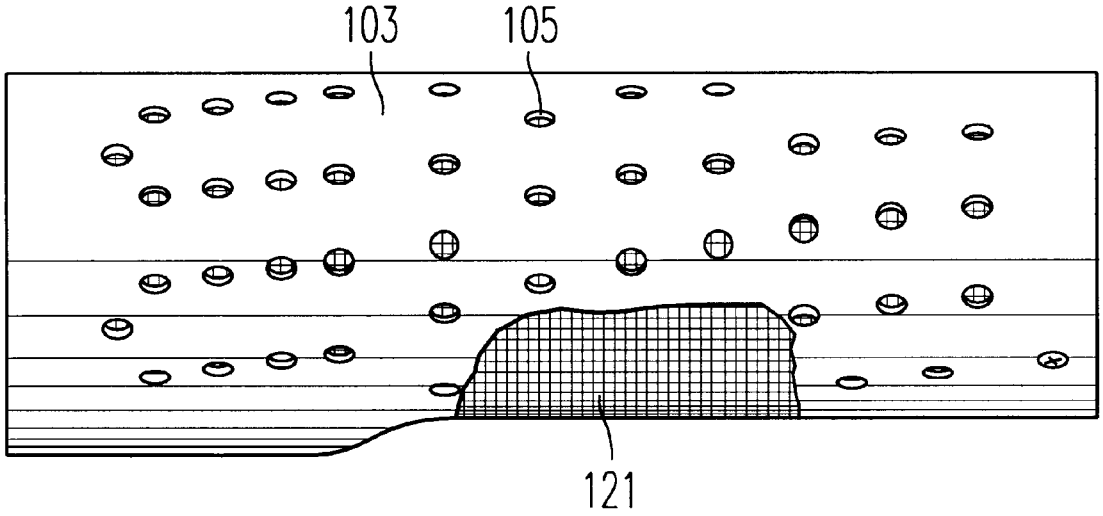
FIG. 23 shows a further variation of the barrel in which the mesh-type screen is positioned radially within the barrel.
Figure 24:
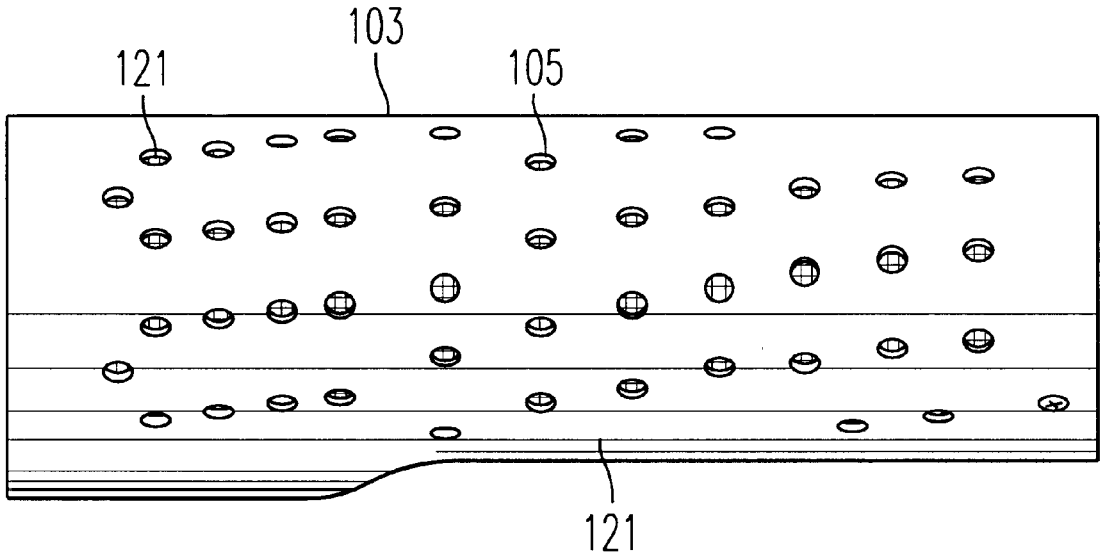
FIG. 24 is a further variation of the barrel of the present invention in which the holes of the barrel are integrated with a mesh-type screen within the holes.

Going back to FIG. 17, during the normal operation of the blow dryer in which the deflector 109 is in the open position (FIG. 19), if the user desires that less air escape through the holes 105 on the barrel 103, as a further embodiment of the invention, the barrel 103 can include a mesh-type screen 121 positioned cylindrically around the barrel 103 (FIG. 18). The mesh-type screen 121 serves to block or obstruct some air traveling through the holes 105 in the blow drying mode of FIG. 19. However, in the variably deflecting positions as well as the deflecting position of FIG. 20 in which the deflector 109 substantially closes the barrel opening 107, enough air will be forced through the holes 105 so as to permit horizontal lifting/drying, etc. The embodiment of the barrel 103 with the mesh-type screen 121 illustrated in FIG. 18 shows the mesh around the barrel 103. However, as a further option, the mesh-type screen 121 can be positioned cylindrically within the barrel 103 as illustrated in FIG. 23 or the mesh-type screen 121 can be integrated into the holes as illustrated in FIG. 24.

Figure 21:
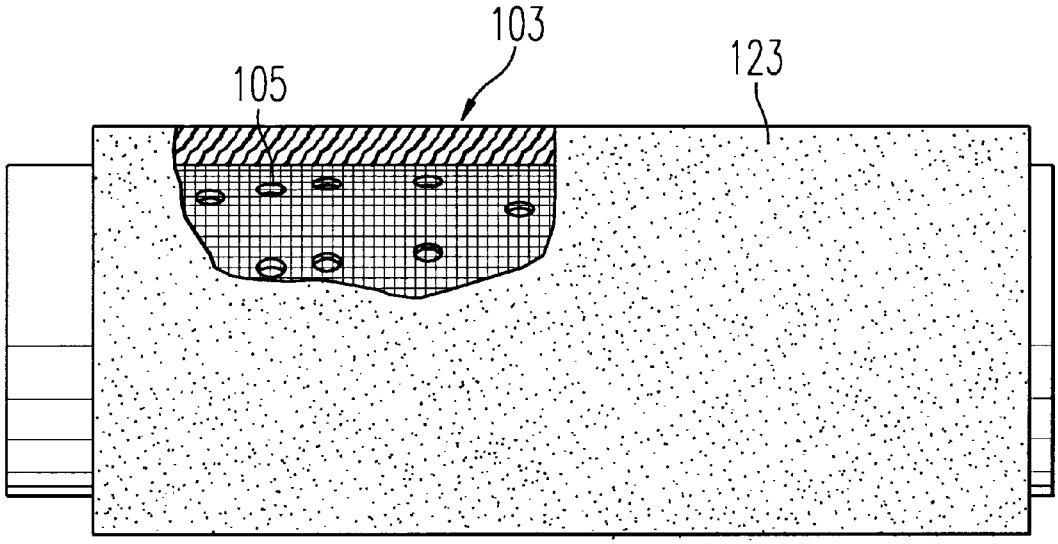
FIG. 21 is a further variation of the barrel of the blow dryer of FIG. 18 in which a removable foam-type mesh surrounds the barrel.

As a further option, the barrel can include a foam-type covering 123 over the mesh-type screen 121 or over the barrel 103 (FIG. 21) so as to further block or obstruct some air traveling through the holes 105 during the normal or conventional blow drying operation of FIG. 19. However, the foam-type covering 123 is porous to permit deflected air forced through the holes 105 when the deflector 109 is in intermediate deflecting positions between the open and substantially closed position or in the substantially closed position (FIG. 20) to escape from the barrel surface, so that the user can utilize the blow dryer for horizontal lifting/drying, etc.

Figure 42A:
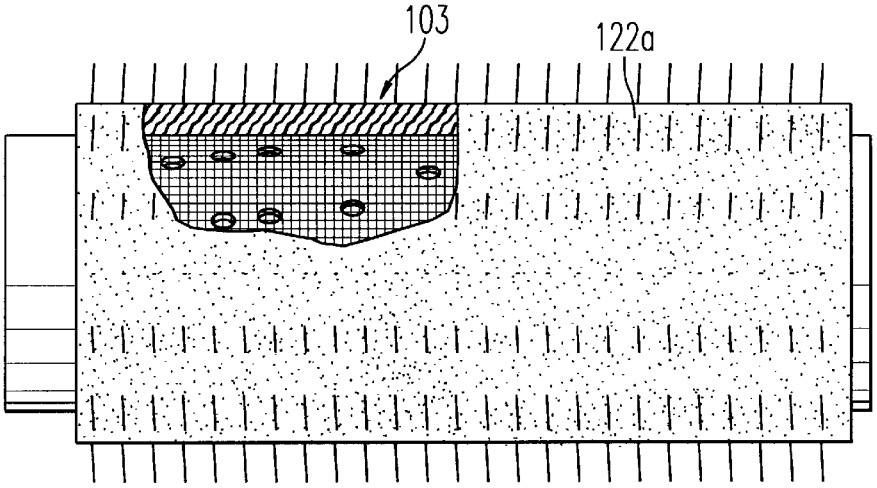
FIG. 42*a* is a variation of the removable foam-type mesh or barrel attachment which surrounds the barrel as shown in FIG. 21 which has projections.
Figure 42B:
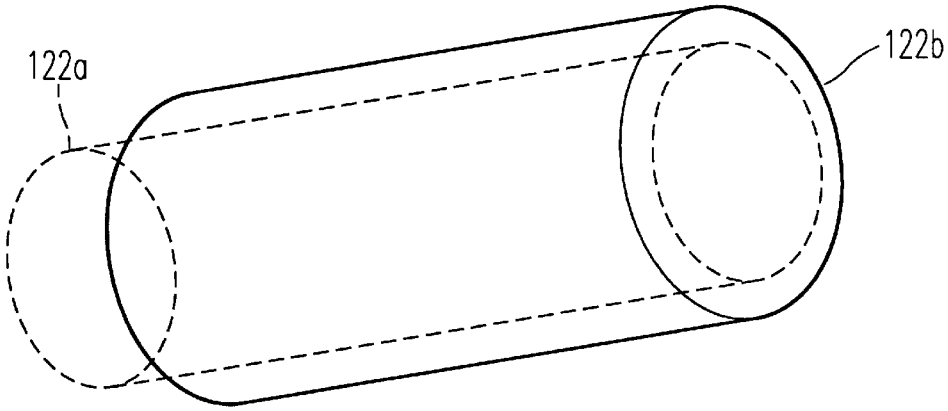
FIG. 42*b* is a perspective view of a barrel attachment frame which can be used to hold a barrel attachment, as shown in FIG. 42*a*, around the barrel.
Figure 42C:
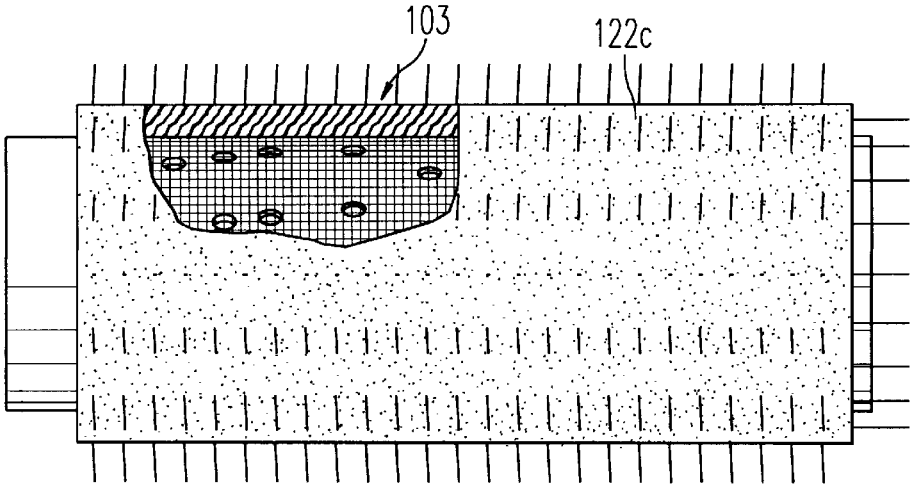
FIG. 42*c* is a variation of the barrel attachment or removable foam-type mesh which surrounds the barrel as shown in FIG. 42*a* which has projections oriented parallel to the length of the barrel.

As a further option, the barrel can include a substantially rigid, foam-type covering or barrel attachment 122*a* having projections over the mesh type screen 121 or over the barrel 103 (FIG. 42*a*) so as to further block or obstruct some air as discussed above and can be utilized to guide hair and for further styling enhancements or massage. The foam-type covering 122*a* having projections may be slipped over the end of the barrel 103. As a further option, the barrel attachment 122*a* can be clipped onto the barrel 103 by a barrel attachment frame 122*b* shown in FIG. 42*b*. The barrel attachment 122*a* shown in broken line. The barrel attachment frame 122*b* is made of a material, such as plastic, which is flexible enough to expand while going around the diameter of the barrel 103 and then to contract back so as to hold the barrel attachment 122*a* on the barrel 103. A substantially rigid material may be used in place of the flexible material provided a hinge-type mechanism is used so that the barrel attachment frame 122*b* can expand and contract around the barrel 103. As a further embodiment of the foam-type covering 122*a* having projections, a plurality of bristles extend substantially parallel to the length of the barrel 103 at an end of the foam-type covering 122*c* as shown in FIG. 42*c*. As an option, the projections can be made without the foam-type covering, resulting in a rigid structure which may be clipped onto the barrel 103 in a manner similar to that discussed above in regard to the barrel attachment frame 122*b*. Depending upon design considerations the barrel attachments may or may not be placed over the holes 105 of the single barrel embodiment or holes 7 of the double barrel embodiment to provide the same result.

The mesh-type screen 121 can be made of any type of material which is capable of withstanding the temperatures which are prevalent in blow drying operations and is bendable into a cylindrical configuration to match the barrel 103. For example, the mesh-type screen 121 can be a frame grid of wire netting. The foam-type arrangement 123 can also be made of any material which is able to withstand the temperatures of a blow drying operation and can be an elastic type member which can be easily slipped on or off of the barrel 103. The material of the mesh and foam arrangements is such that in the deflecting positions of the blow dryer (FIG. 20), air forced out through the holes 105 can pass through the materials for the use of the blow dryer for horizontal lifting/drying, etc.

Figure 22:
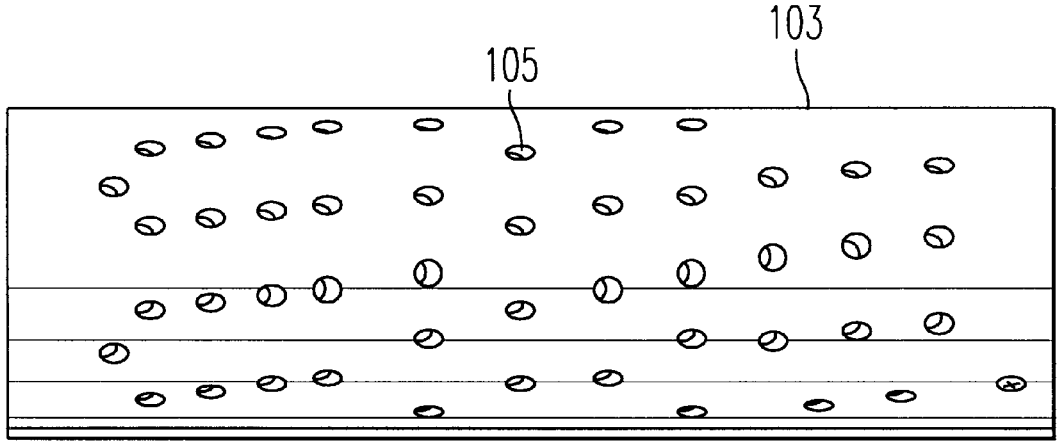
FIG. 22 shows a further variation of the barrel in which the plurality of holes on the barrel assembly are slanted.

As a further feature of the present invention the holes 105 on the barrel 103 can be slanted (FIG. 22) so as to provide for a variation in the direction of air in the deflecting position (FIG. 20), and also provide for a desired obstruction of air when the blow dryer is used in a normal operation (FIG. 19) in which the deflector 109 is open. Although FIG. 22 illustrates the holes 105 as slanted in one direction, it is recognized that the holes 105 can be slanted in various directions depending on design considerations.

Also, although the illustrated blow dryer of FIG. 17 shows a belly-type body, the actuator 119 can be positioned anywhere with respect to the blow dryer assembly depending on the type of barrel and blow dryer body utilized. The blow dryer of the above-noted embodiments can also use a control mechanism 50 as illustrated in FIG. 13 and actuation as illustrated in FIG. 39. Additionally, the barrel of the blow dryer of these embodiments can include the modifications with respect to the rings 200, 350 and the bristles or teeth 300, 271, 275, 280, 282 illustrated in FIGS. 14, 15, 37, 38*a*, 38*b*, 38*c*, 40 and 41.

Thus, the blow dryer of the present invention maximizes the blow dryer's capability by incorporating multiple functions in one tool. It thereby provides a user with a wide range of airflow use by utilizing a single tool that is operated by one hand. That is, by simply actuating an actuator such as pulling on the trigger 12, the user can vary the air flow through the barrel. Any desired attachments can be fitted over the barrel of the present invention just as with current blow dryers, and used whether or not the actuator is operated. The blow dryer of the present invention can also be used as a large hot roller, and it has diffusing capabilities from the barrel opening when the actuator is operated and also from the entire barrel surface.

Figure 29:
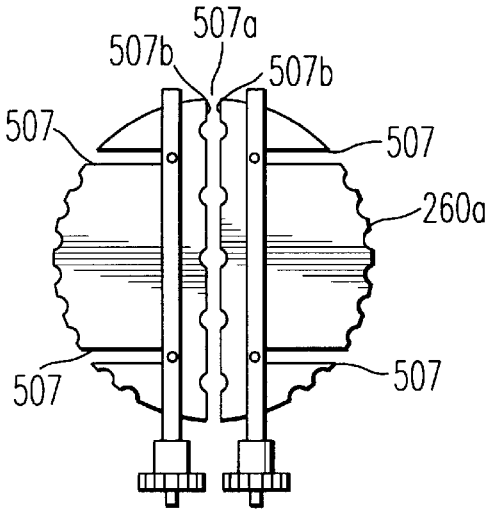
FIG. 29 shows flaps having scalloped edges, and vertical and horizontal slits.
Figure 32:
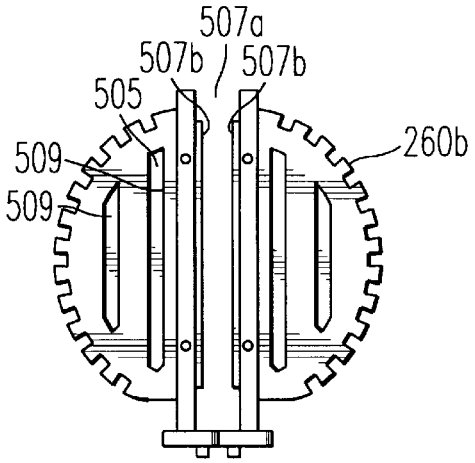
FIG. 32 shows flaps having serrated edges, and vertical slits including raised brackets.
Figure 30:
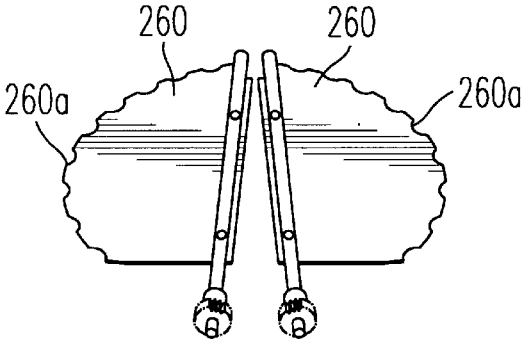
FIG. 30 shows flaps having scalloped edges.
Figure 33:
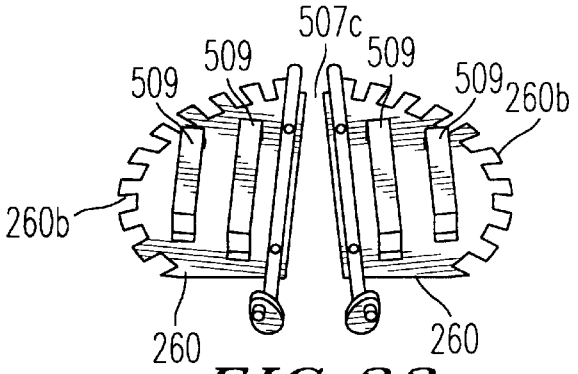
FIG. 33 shows a perspective view of the serrated edged flaps with raised brackets.

FIGS. 29–34 illustrate further embodiments of the flaps or deflector of the present invention. The flaps 260 can have a scalloped outer periphery 260*a* as shown in FIG. 30 or a serrated outer periphery 260*b* as shown in FIG. 33. This arrangement permits a user to further fine tune the amount of air flow through the barrel 3. Furthermore, the gap 507*a* which exists between the facing surfaces 507*b* of the flaps may be scalloped, serrated, or made to have a varying width 507*c* so as to provide the desired diffusion of air flow. Additionally, the flow of air past the gap 507*a*, scallops, serrations, vertical and horizontal slits 505, 507, create apertures through which the air flows so as to diffuse the air and to reduce any potential overheating problem of the blow dryer's heating element. The scalloped or serrated deflector 260 can be utilized in any of the previously discussed embodiments including the embodiment with the single barrel or the embodiment which includes the inner and outer barrels. Furthermore, regular flaps, as shown in FIGS. 1–28, can be utilized in any of the previously discussed embodiments.

Figure 11A:
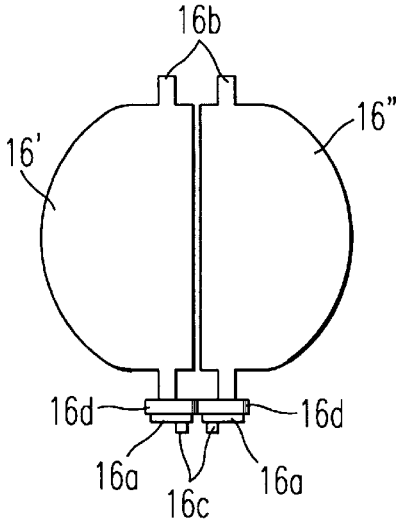
FIG. 11(*a*), 11(*b*) and 11(*c*) show different views of the flaps.
Figure 11B:
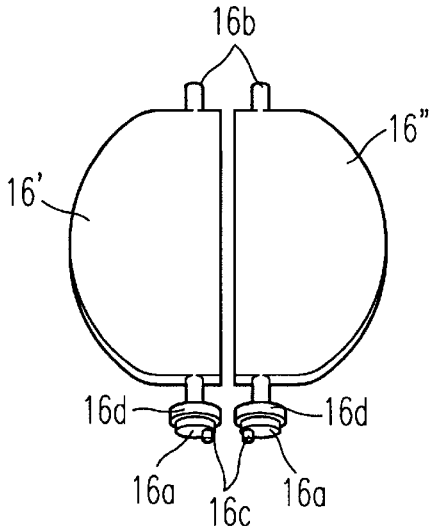
Figure 11C:
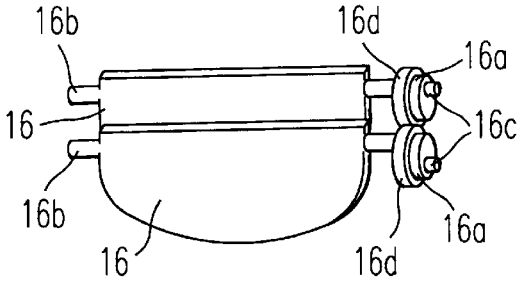
Figure 36:
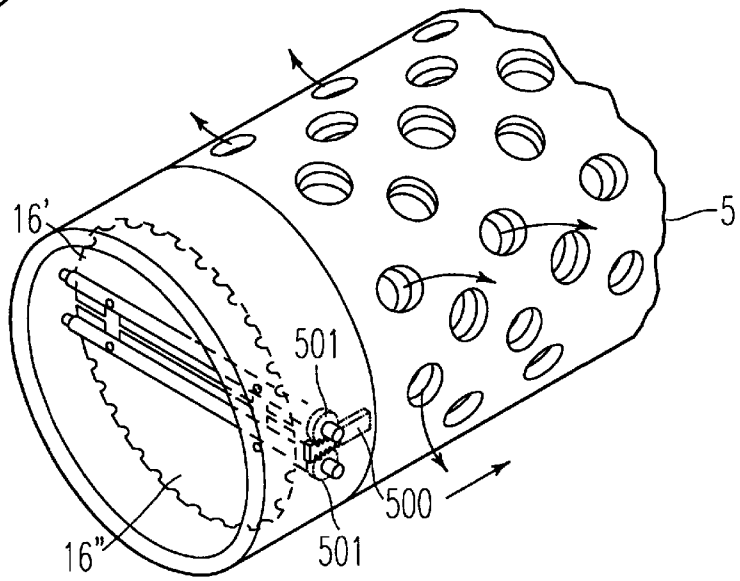
FIG. 36 shows the rack gear arrangement with the flaps closed or in a fully deflecting position.

FIG. 35 shows a further embodiment for moving the outer cylinder 5 with respect to the inner cylinder 4. As illustrated in FIG. 35 a rack gear arrangement can be utilized to achieve this movement as previously described. As shown in FIG. 35, the outer cylinder 5 can include a rack gear 500 which cooperates with at least two rotatable spur gears 501 which can be rotatably mounted on the inner cylinder 4. It is noted that the number of spur gears used is based on design considerations. The at least two spur gears 501 can be mounted on the mounting axles 16*b* (16*b* shown in FIG. 26) of the deflector such that a rotation of the spur gears 501 will cause a rotation of the flaps 16', 16". Therefore, a movement of the outer cylinder 5 through the use of the trigger 12 will cause a movement of the rack 500 in engagement with the spur gears 501. The rotation of the spur gears 501 will cause a movement of the flap 16', 16" between an open position illustrated in FIG. 35 and an at least a substantially closed position as illustrated in FIG. 36. It is further recognized that through the use of the rack and spur gear arrangement, a desired number of intermediate positions can be achieved between the open and substantially closed position so as to provide for a concentrated air flow. The direction of rotation of the flaps 16', 16" from the substantially closed position to the open position or vice versa, and the positioning of the flaps 16', 16" in the substantially open position is based on design considerations. For example, in the substantially open position, the flaps 16', 16" can be directed toward the inside of the barrel and positioned at various intermediate positions so as to permit a concentrated air flow. As an alternative, it is further noted that rather than on the outer cylinder, the rack gear arrangement can be placed on the inner cylinder. With this alternative arrangement, the inner cylinder would be movable while the spur gears can be rotatably positioned on a fixed outer cylinder. Furthermore, the rack gear arrangement utilizing a rack gear 500 operationally connected to the trigger 119 and cooperating with at least two rotatable spur gears 501 mounted on a single barrel 103 can be used in any of the previously discussed embodiments. Additionally, the deflector can be a deflector as illustrated in FIGS. 11A–11C or can have a scalloped edge as illustrated in FIG. 30 or a serrated edge as illustrated in FIG. 33, or of flaps of a general shape as in FIGS. 1–28, where shown.

Figure 31:
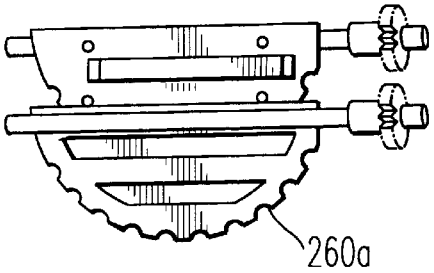
FIG. 31 shows another view of the scalloped edged flaps.
Figure 34:
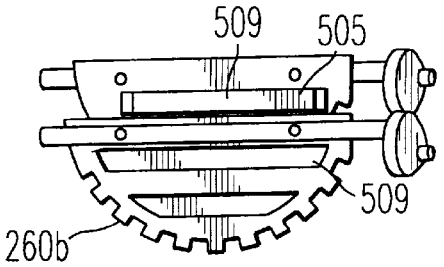
FIG. 34 shows still another view of the serrated edged flaps.

As a further feature of the flaps of the present invention, they can include vertical or horizontal slits (505, 507) as illustrated in FIGS. 29 and 32. Slits can also be included at the mid-span of the flaps, as shown in FIGS. 29 and 31, so as to provide clearance between the flaps and heating elements within the barrel when the flaps are in the open position. This arrangement permits a further customization of the air flow. The flaps can also include slits having frame-like brackets 509 positioned either in front or behind the slits with respect to the direction of air flow as illustrated in FIGS. 32–34. This specific arrangement further customizes the flow of air through the barrel opening when the deflector is positioned at any position. The slits and frame-like brackets can be used in flaps having the configuration illustrated in FIGS. 11A–11C or can be used with the flaps having a scalloped outer periphery as illustrated in FIGS. 29–31 or a serrated outer periphery as illustrated in FIGS. 32–34, or the generally shaped flaps illustrated in FIGS. 1–28, where shown, can be similarly modified.

Figure 43:
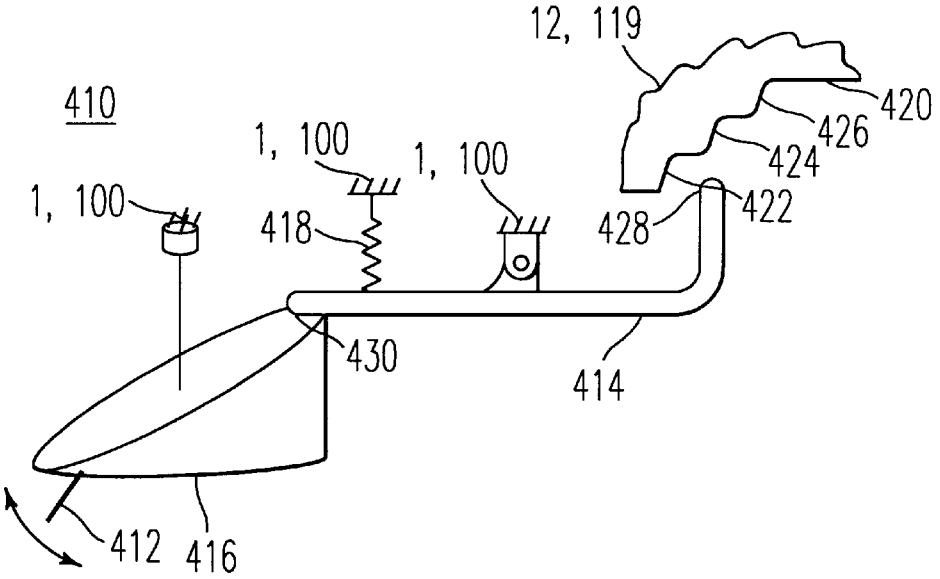
FIG. 43 is a partial perspective side view of a first stop mechanism.

As a further feature of the present invention a first stop mechanism 410, as shown in FIG. 43, is provided on the blow dryer body 1, 100, of either the single barrel embodiment or the embodiment that includes the inner and outer barrels, so as to maintain the actuator 12, 119 in an intermediate or final position. The first stop mechanism 410 provides for a "normal" mode in which the blow dryer operates as previously described, a "concentrator" mode in which the trigger mechanism 12, 119 is maintained in an intermediate position, and a "fully diffusing" mode in which the trigger mechanism 12, 119 is maintained in a final or fully diffusing position. As an example FIGS. 5 and 19 illustrate flaps in an open position for an inner and outer barrel embodiment and a single barrel embodiment, respectively. As another example FIGS. 26 and 28 illustrate flaps in an intermediate position for an inner and outer barrel embodiment and a single barrel embodiment, respectively. As a final example FIGS. 7 and 20 illustrate flaps in a final or fully deflecting position for an inner and outer barrel embodiment and a single barrel embodiment, respectively.

The first stop mechanism 410, as shown in FIG. 43, includes a cammed lever 412 rotatably connected to the blow dryer body 1 or 100, a pivot member 414 in contact with a cam 416 of the cammed lever 412 and pivotally connected to the blow dryer body 1 or 100, a biasing spring 418 connected to the blow dryer body 1 or 100 and in contact with the pivot member 414 so as to urge the pivot member 414 against the cam 416 of the cammed lever 412, and a trigger lock 420 attached to the trigger 12 or 119 having a "normal" mode surface 422, an intermediate "concentrator" mode surface 424, and a "fully diffusing" mode surface 426.

In operation the user can selectively adjust the first stop mechanism 410 to the "normal" mode in which the cammed lever 412 is rotated until an engagement end 428 of the pivot member 414 is in-line with the "normal" mode surface 422. The "normal" mode allows for normal use of the blow dryer, i.e. the flaps can be continuously adjusted between a full open position and a fully diffusing position.

When the user adjusts the first stop mechanism 410 to the "concentrator" mode in which the cammed lever 412 is rotated until the engagement end 428 of the pivot member 414 is in-line with the "concentrator" mode surface 424. The cam 416 is inclined so that when the cammed lever 412 is rotated a cam end 430 of the pivot member 414 is pushed toward the blow dryer in opposition to the force of the compressed biasing spring 418. To maintain the desired position, the trigger 12 or 119 may be previously depressed so as to be in a fully deflecting position, then the trigger 12 or 119 can be released and the engagement end 428 of the pivot member 414 contacts the "concentrator" mode surface 424. The finger of the user can now be taken off of the trigger 12 or 119 and the position of the flaps (and the position of the inner and outer barrels in case of such an embodiment) of the blow dryer is maintained. If the trigger 12 or 119 is depressed to the fully deflecting position, thus disengaging the engagement end 428 and the "concentrator" mode surface 424 the compressed biasing spring 418 can not expand since the pitch, incline, or angle of the cam 416 is such that the force of the biasing spring 418 can not back-drive the cam 416. Therefore, when the trigger 12 or 119 is released first stop mechanism 410 returns to the "concentrator" mode position.

When the user adjusts the first stop mechanism 410 to the "fully diffusing" mode in which the cammed lever 412 is rotated until the engagement end 428 of the pivot member 414 is in-line with the "fully diffusing" mode surface 426. The operation of the first stop mechanism 410 in this position is similar to that discussed for the "concentrator" mode.

Figure 44:
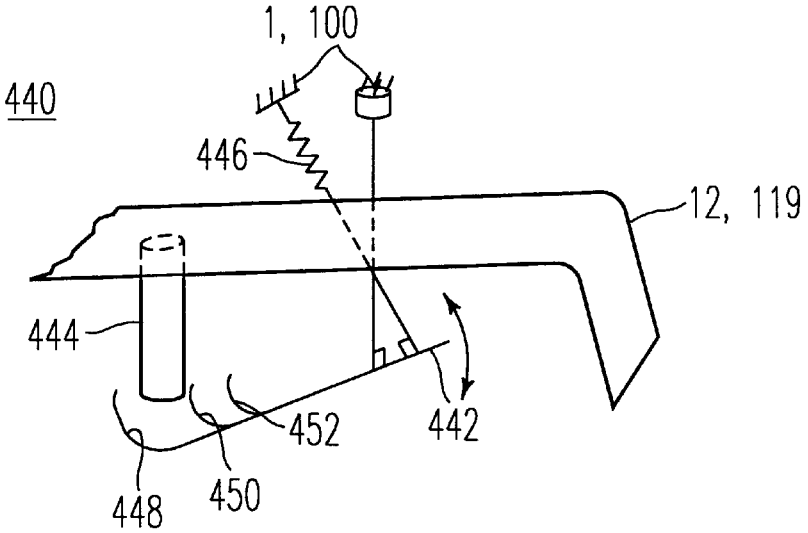
FIG. 44 is a partial perspective side view of a second stop mechanism.

As an alternative to the first stop mechanism 410, a second stop mechanism 440, as shown in FIG. 44, can be provided on the blow dryer body 1, 100, of either the single barrel embodiment or the embodiment that includes the inner and outer barrel, so as to maintain the actuator 12, 119 in an at least intermediate or final position. The second stop mechanism 440 provides for positions similar to those described in reference to the first stop mechanism 410, but accomplishes the function differently, as described below.

The second stop mechanism 440, as shown in FIG. 44, includes a selector lever 442 rotatably connected to the blow dryer body 1 or 100, a locking pin 444 attached to the trigger 12 or 119 designed to be engageble with the selector lever 442, a biasing spring 446 connected to the blow dryer body 1 or 100 at one end and to the selector lever 442 at the other end, the biasing spring 446 tends to urge the selector lever 442 away from the locking pin 444. The selector lever 442 has at one end a "normal" mode surface 448, an intermediate "concentrator" mode surface 450, and a "fully diffusing" mode surface 452.

In operation the user can adjust the second stop mechanism 440 to the "normal" mode by depressing the trigger 12 or 119 to the fully deflecting position, at which time the biasing spring 446 rotates the selector lever 442 away from the locking pin 444. The "normal" mode surface 448 is larger or longer than the "concentrator" mode surface 450 and the "deflecting" mode surface 452, so that when the trigger 12 or 199 is depressed to the fully deflecting position, as described above, the surfaces 452 and 450 can not engage the locking pin 444, only the "normal" mode surface 448 is large or long enough to engage the locking pin 444. The "normal" mode allows for normal use of the blow dryer, i.e. the flaps can be continuously adjusted between a full open position and a fully diffusing position.

When the user adjusts the second stop mechanism 440 to the "concentrator" mode the user depresses the trigger 12 or 119 to the fully deflecting position and rotates the selector lever 442 until the locking pin 444 is in-line with the "concentrator" mode surface 450, then while holding the selector lever 442 in the desired position, the trigger 12 or 119 is released, thus maintaining the "concentrator" mode position. However, unlike the first stop mechanism 410, if the trigger 12 or 119 is subsequently depressed the default position does not remain the "concentrator" position. The default position becomes the open or normal position. This occurs since, when the trigger 12 or 119 is depressed the biasing spring 446 rotates the selector lever 442 away from engagement with the locking pin 444.

When the user adjusts the second stop mechanism 440 to the "fully deflecting" mode, the user rotates the selector lever 442 until the locking pin 444 is in-line with the "fully deflecting" mode surface 452. The operation of the second stop mechanism 440 in the "fully deflecting" position is similar to that described above in regard to the selection of the "concentrator" mode position.

Another alternative stop mechanism can be provided, taking the form as a third stop mechanism 460, as shown in FIGS. 45*a*–45*d*, provided on the blow dryer body 1, 100, of either the single barrel embodiment or the embodiment that includes the inner and outer barrel, so as to maintain the actuator 12, 119 in intermediate or final positions. The third stop mechanism 460 provides for positions similar to those described in reference to the description of the first and second stop mechanisms 410, 440, respectively.

The third stop mechanism 460 includes a tooth bar 462 pivoted at one end to the blow dryer body 1 or 100, a release lever 464 pivoted at one end to the blow dryer body 1 or 100, the release lever 464 having a contact surface 466 which contacts the tooth bar 462, a biasing spring 468 connected to the blow dryer body 1 or 100 at one end and to the tooth bar 462 at the other end, the biasing spring 468 urges the tooth bar 462 toward the release lever 464, a trigger hook 470 connected to the actuator 12, 119, the trigger hook 470 connected to the actuator 12, 119, the trigger hook 470 having a shape so as to be engageable with a "normal" mode surface 472, a first "concentrator" mode surface 474, a second "concentrator" mode surface 475 and a "fully diffusing" mode surface 476 of the tooth bar 462.

Figure 45A:
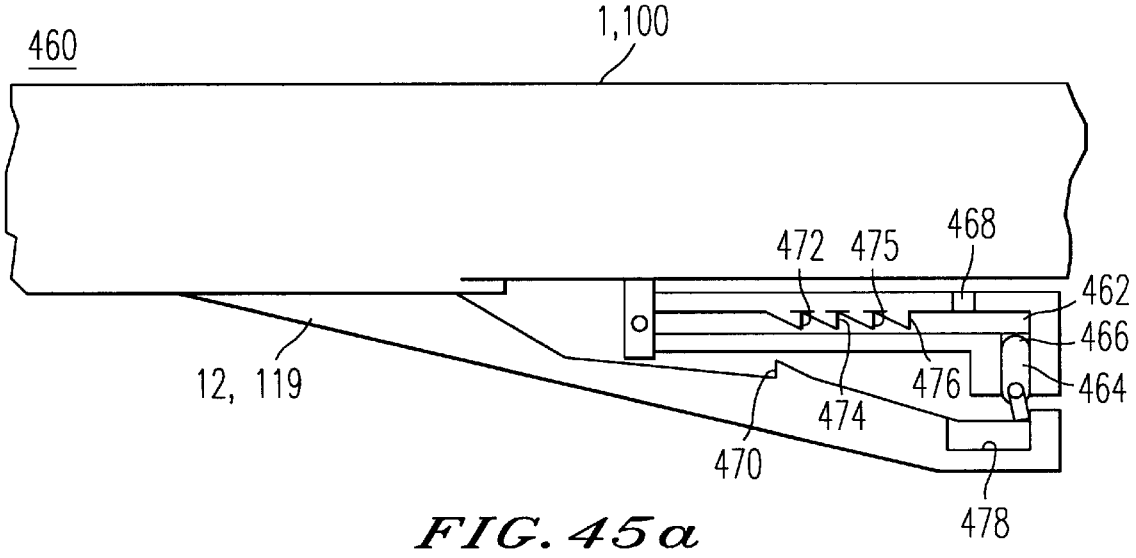
FIGS. 45*a*–45*d* are side views of a third stop mechanism.
Figure 45B:
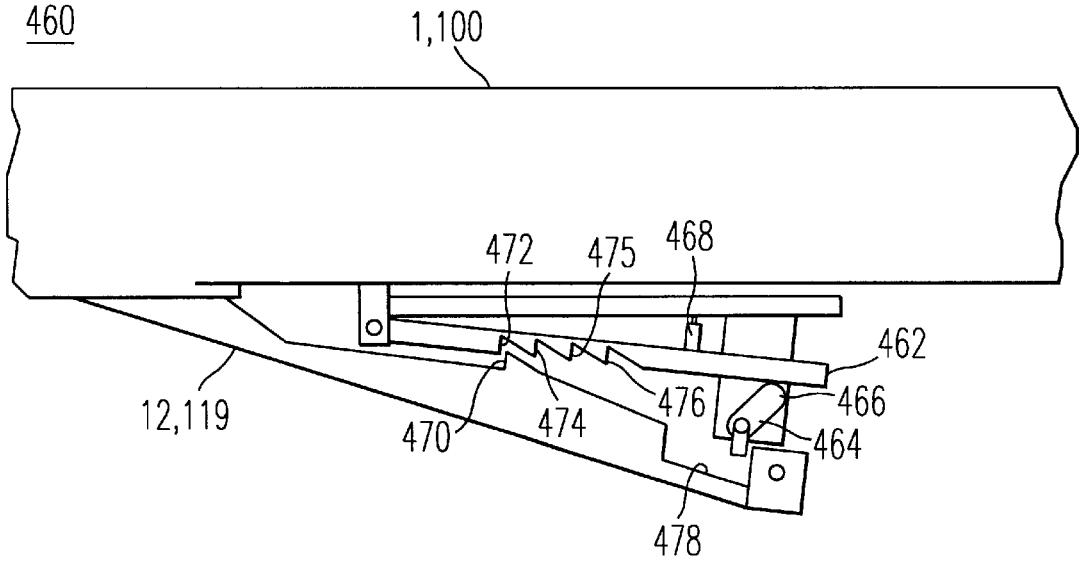

In operation the user can adjust the third stop mechanism 460 to the "normal" mode by pulling or depressing the trigger 12, 119 all the way back ensuring that the contact surface 466 of the release lever 464 contacts the tooth bar 462, the tooth bar 462 being urged against the contact surface 466 by the biasing spring 468. In such a configuration the trigger hook 470 does not contact the tooth bar 462 until the actuator 12, 119 is released thus a trigger slot 478 of the trigger 12, 119 causes the release lever 464 to rotate in a clockwise direction as shown in FIG. 45*b*. The rotation of the release lever 464 causes the tooth bar 462 to engage with the trigger hook 470 with the "normal" mode surface 472, as shown in FIG. 45*b*.

Figure 45C:
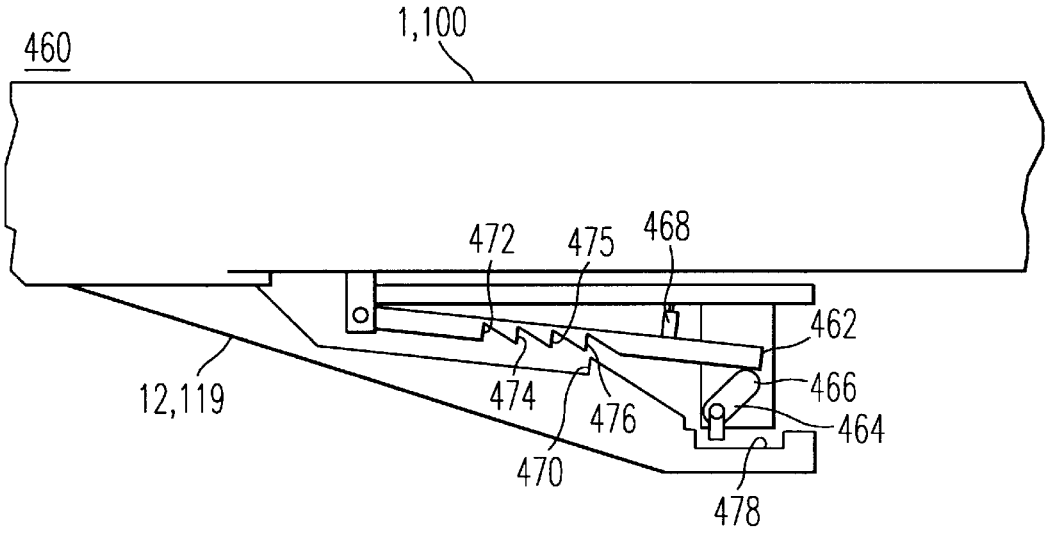

Once the trigger hook 470 is engaged with the "normal" mode surface 472, as the trigger 12 or 119 is depressed the trigger hook 470 slides against the tooth bar 462 and eventually engages the first "concentrator" mode surface 474. As the trigger 12 or 119 is further depressed the trigger hook 470 successively engages surfaces 475 and 476. If the user does not further depress the trigger 12 or 119 as the trigger hook 470 engages any one of the surfaces 472, 474, 475 and 476 then the trigger hook 470 remains engaged with the selected surface which corresponds with the selected mode of operation, so that the dryer can be used without the user keeping his finger on the trigger 12 or 119 while the desired mode of operation is maintained. FIG. 45*c* illustrates the engagement of the trigger hook 470 with the "fully diffusing" mode surface 476.

Figure 45D:
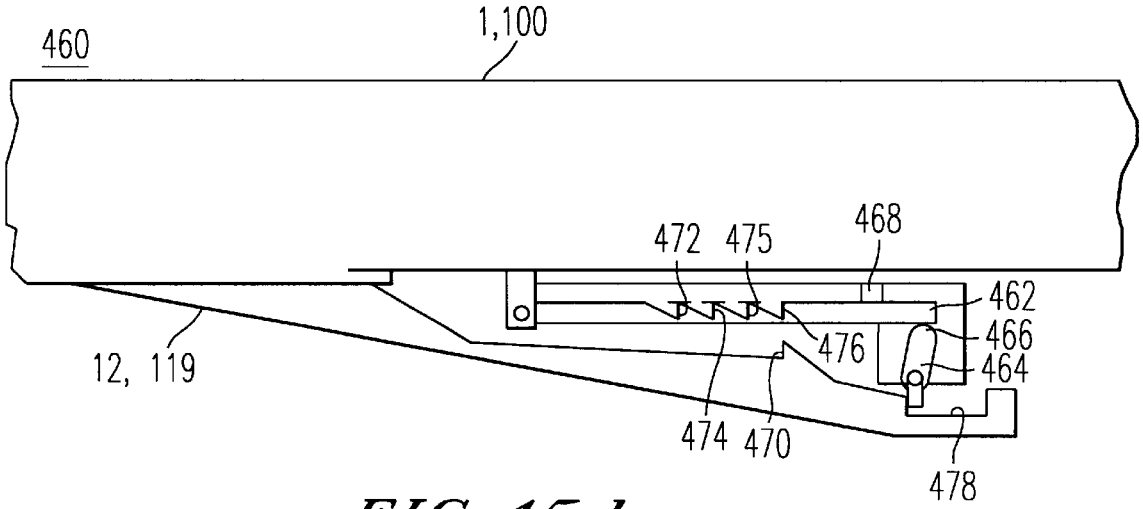

If the user further depresses the trigger 12 or 119 beyond the "final" mode surface 476, then the release lever 464 is rotated counter clock wise by one end of the trigger slot 478 as shown in FIG. 45*d*, thus causing the tooth bar 462 to rotate away from the trigger hook 470. In such a position the trigger 12 or 119 is freely movable since the trigger hook 470 is not able to engage with any of the surfaces of the tooth bar 462. FIGS. 45*a* and 45*d* illustrate the tooth bar 462 rotated away from the trigger hook 470. This third stop mechanism 460 allows for single hand use of the blow dryer and adjustments of the deflector positions.

Still another alternative stop mechanism can be provided, taking the form of a fourth stop mechanism 560, as shown in FIGS. 46*a*–46*d*, provided on the outer cylinder 5 of barrel 3 of blow dryer body 1 or barrel 103 of the blow dryer body 100, (of either the single cylinder embodiment or the embodiment that includes the inner and outer cylinder), so as to maintain the actuator 12, 119 in normal, intermediate or final positions. The fourth stop mechanism 560 provides positions similar to those described in reference to the description of the first through third stop mechanisms 410, 440, 460, respectively. Similar to the third stop mechanism 460, this fourth stop mechanism 560 allows for single hand use of the blow dryer and adjustment of the deflector positions.

Figure 46A:
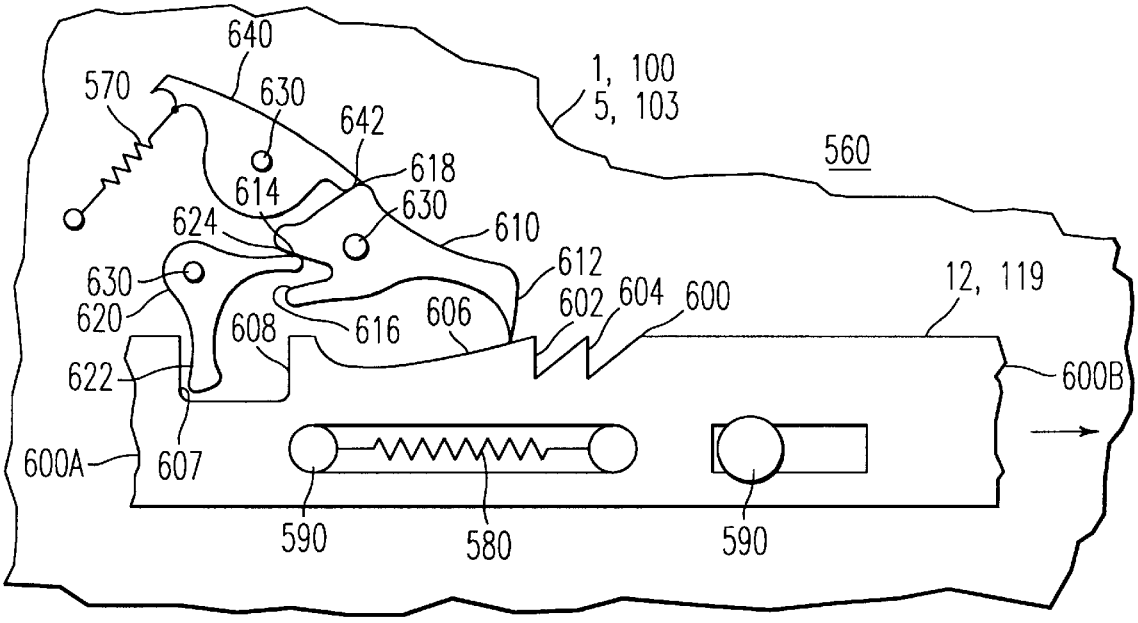
FIGS. 46*a*–46*d* are views of a fourth stop mechanism.

The fourth stop mechanism 560 includes guide pins 590 fixedly attached to the barrel 5 or 103 of the blow dryer body 1 or 100, a tooth rack 600 slidingly engaged with the guide pins 590, a compression spring known as a reset spring 580 attached at one end to one of the guide pins 590 and at the other end to the tooth rack 600 so as to urge the tooth rack 600 towards the guide pins 590, as shown in FIG. 46*a*, a force balance member 640 pivotally attached to a pivot pin 630, the pivot pins 630 being fixedly attached to the barrel 5 or 103 of the blow dryer body 1 or 100, a compression spring known as an insertion spring 570 attached at one end to the barrel 5 or 103 of the blow dryer body 1 or 100 and at the other end to the force balance member 640, the insertion spring 570 urges the force balance member 640 towards an engagement pawl 610, the engagement pawl 610 is pivotally attached to one of the pivot pins 630, a reset member 620 is pivotally attached to one of the pivot pins 630, the reset member 620 engages with the tooth rack 600 at one end and with the engagement pawl 610 at another end. One end 600A of the tooth rack 600 is near the trigger and the other end 600B of the tooth rack 600, as shown in FIG. 46*a*, is near to and operably attaches to the deflector and/or cylinders of the barrel. The components connected to the barrel 5 or 103 through the pins 630 are known as the barrel portion of the stop mechanism 560.

The tooth rack 600 has a rest surface 606 on which a hook 612 of the engagement pawl 610 may rest when the blow dryer is in the "normal" mode when the air flow exiting the blow dryer barrel is not deflected, as shown in FIG. 46*a*. Furthermore, a first contact end 622 of the reset member 620 contacts a first bearing surface 607 of the tooth rack 600. A second contact end 624 of the reset member 620 contacts a first bearing surface 614 of the engagement pawl 610. A third bearing surface 618 of the engagement pawl 610 contacts a first bearing surface 642 of the force balance member 640, as shown in FIG. 46*a*.

Figure 46B:
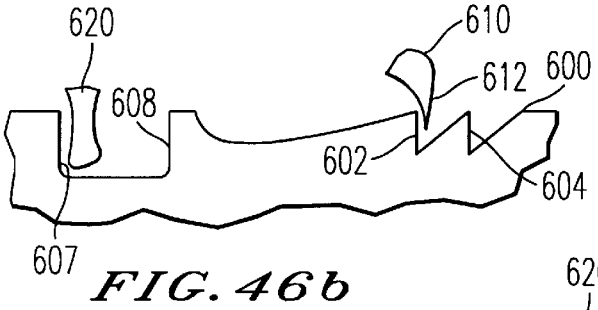

The tooth rack 600 has a first indentation 602 which represents an intermediate stop position when the hook 612 of the engagement pawl 610 is engaged with the first indentation 602, as shown in FIG. 46*b*. The intermediate stop position maintains the flaps in the intermediate deflecting position or "concentrator" mode. In this mode the first contact end 622 of the reset member 620 does not contact the first bearing surface 607 of the tooth rack 600. Also, the second contact end 624 of the reset member does not contact the first bearing surface of the engagement pawl 610, thus the force of the insertion spring 570 forces the hook 612 of the engagement pawl 610 towards the tooth rack 600. Furthermore, the reset spring 580 becomes compressed, thus urging the first indentation 602 towards the hook 612.

Figure 46C:
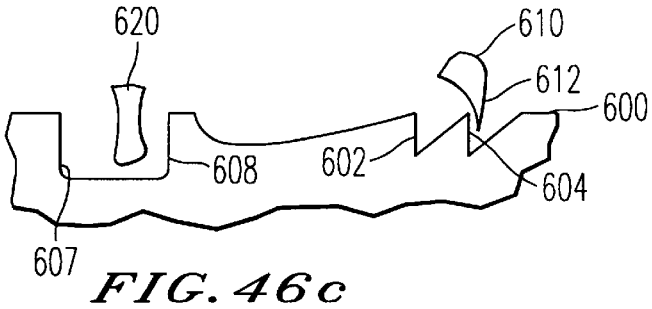

The tooth rack 600 also has a second indentation 604 which represents a final stop position when the hook 612 of the engagement pawl 610 is engaged with the second indentation 604, as shown in FIG. 46*c*. The final stop position maintains the flaps in the fully deflecting position or "fully diffusing" mode.

Figure 46D:
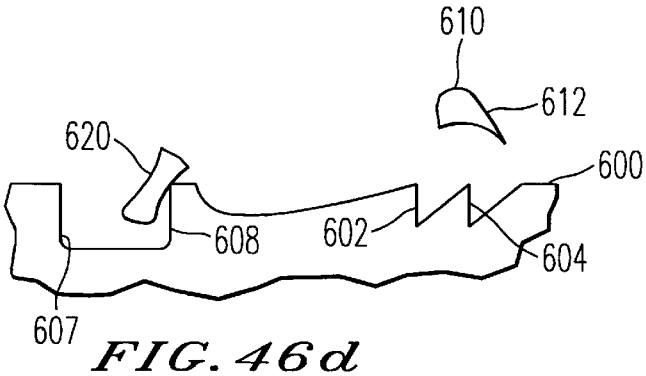

In operation the user can adjust the fourth stop mechanism 560 to the "normal" mode from the "fully diffusing" mode by further depressing the trigger 12 or 119 to which the tooth rack 600 is attached, also known as a trigger portion, at which time the first contact end 622 of the reset member 620 contacts a second bearing surface 608 of the engagement pawl 610. Such movement causes the second contact end 624 of the reset member 620 to contact a second bearing surface 616 of the engagement pawl 610, thus rotating the engagement pawl 610 counterclockwise as viewed in FIG. 46*a*. The rotation of the engagement pawl 610 causes the third bearing surface 618 of the engagement pawl 610 to contact the first bearing surface 642 of the force balance member 640. As the trigger or actuator is further depressed, a point is reached where the forces are, at a minimum, balanced about the force balance member. That is the engagement pawl 610 has locked the force balance member 640 in place. In such a position the hook 612 of the engagement pawl 610 is fully removed from the indentations 602, 604, 606 of the tooth rack 600, as shown in FIG. 46*d*. Therefore, if the user releases the trigger, the compressed, reset spring 580 urges the tooth rack 600 and associated trigger assembly towards the "normal" position, as shown in FIG. 46*a*. Just before the "normal" mode position is reached the first contact end 622 of the reset member 620 contacts the first bearing surface 607 of the tooth rack 600, thus rotating the reset member 620 about the pivot pin 630 and contacting the second contact end 624 of the reset member 620 against the first bearing surface 614 of the engagement pawl 610, thus causing the engagement pawl 610 to rotate about its associated pivot pin 630, in a clockwise direction so as to move the hook 612 closer to the rest surface 606 of the hook rack 600, and one cycle of operation is completed by using one hand, which is also the same hand that holds the blow dryer.

Yet another alternative stop mechanism can be provided, taking the form of a fifth stop mechanism 660, as shown in FIGS. 47*a*–47*e*, provided on the outer cylinder 5 of barrel 3 of blow dryer body 1 or barrel 103 of the blow dryer body 100, (of either the single cylinder embodiment or the embodiment that includes the inner and outer cylinders), so as to maintain the actuator 12 or 119 in at least normal, intermediate or final positions. The fifth stop mechanism 660 provides positions similar to those described in reference to the description of the first through fourth stop mechanisms 410, 440, 460, and 560, respectively. Similar to the third and fourth stop mechanisms 460, 560, this fifth stop mechanism 660 allows for single hand use of the blow dryer and adjustment of the deflector positions.

Figure 47A:
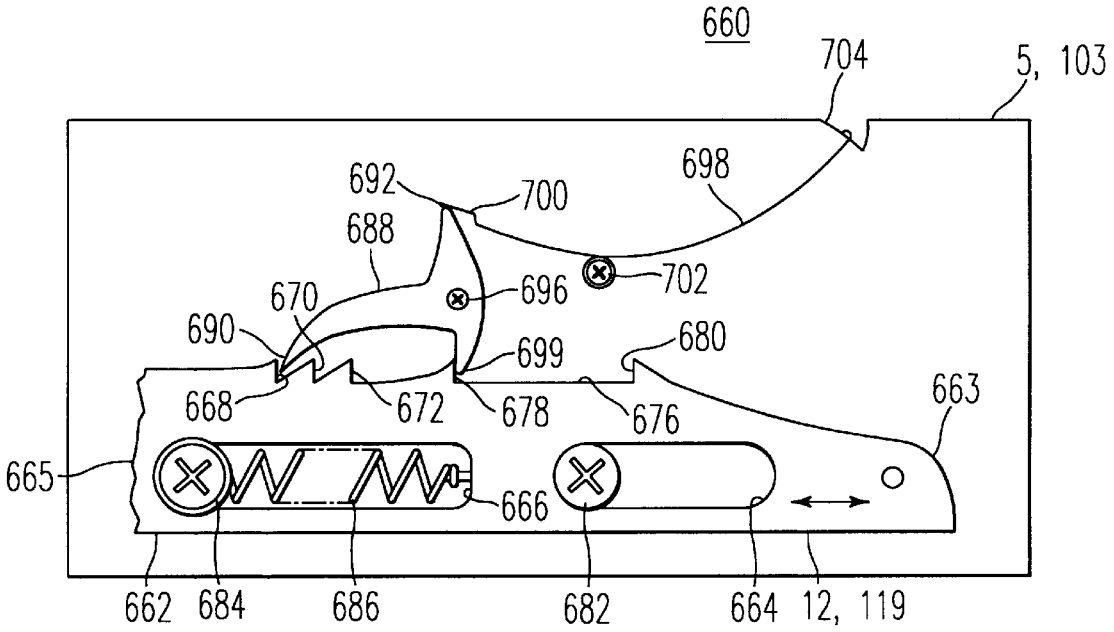
FIGS. 47*a*–47*e* are views of a fifth stop mechanism.

The fifth stop mechanism 660 includes guide pins 684 and 682 fixedly attached to the barrel 5 or 103 of the blow dryer body 1 or 100, a tooth rack 662 slidingly engaged with the guide pins 684, 682 in openings 666, 664, respectively, a compression spring known as a reset spring 686 attached at one end to guide pin 684 and at its other end to an edge of the opening 666 of the tooth rack 662 so as to urge the tooth rack 662 towards the guide pin 684 as shown in FIG. 47*a*, a pawl 688 pivotally attached to a pivot pin 696, the pivot pin 696 being fixedly attached to the barrel 5 or 103 of the blow dryer body 1 or 100, and a coiled spring 698 coiled around a fixed pin 702 and contacting the barrel 5 or 103 of blow dryer body 1 or 100 at notch 704 and contacting the locking surface 692 of the pawl 688, the coiled spring 698 urges an hook 690 of the pawl 688 towards the tooth rack 662. The fixed pin 702 is fixedly attached to the barrel 5 or 103 of the blow dryer body 1 or 100. The notch 704 secures and reacts the force generated by the coiled spring 698 when it is compressed. The pawl 688 has a reset end 694 which contacts a normal mode engagement surface 678 of a reset channel 676 of the tooth rack 662 when the stop mechanism 660 begins a cycle at the "normal" mode after being at the "fully deflecting" mode. The reset channel 676 of the tooth rack 662 also has a fully deflecting disengagement surface 680 which the reset end 694 of the pawl 688 contacts before the reset end 694 contacts the normal mode engagement surface 678. One end 663 of the tooth rack 662 is near to and operably attaches to the deflector and/or cylinders of the barrel, as shown in FIG. 47*a*, and the other end 665 of the tooth rack 662 is near the trigger 12 or 119. The components connected to the barrel 5 or 103 through pins 696 and 702 are known as the barrel portion of the stop mechanism 660.

The tooth rack 662 has a first indentation 668 on which the hook 690 of the pawl 688 rests when the blow dryer is in the "normal" mode when the airflow exiting the blow dryer barrel is not deflected, as shown in FIG. 47*a*. As shown, the coiled spring 698 presses on the locking surface 692 so as to urge the hook 690 of the pawl 688 towards the surface of the first indentation 668.

Figure 47B:
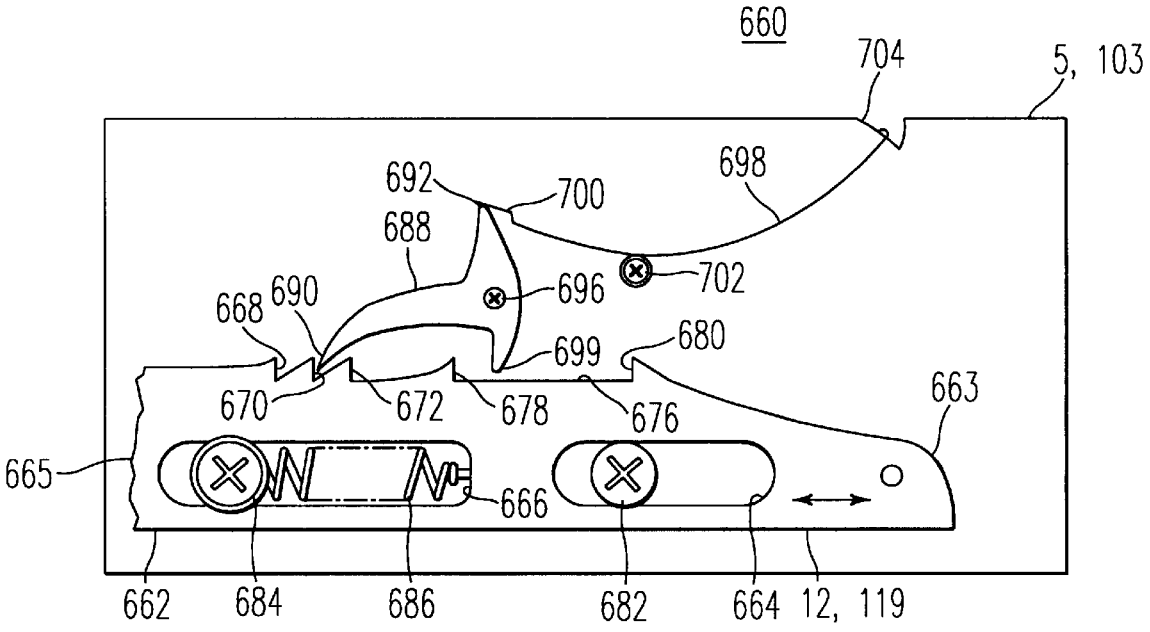

The tooth rack 662 has a second indentation 670 which represents an intermediate stop position when the hook 690 of the pawl 688 is engaged with the second indentation 670, as shown in FIG. 47*b*. The intermediate stop position maintains the flaps in the intermediate deflecting position or "concentrator" mode. The coiled spring 698 presses on the locking surface 692 of the pawl 688 to urge the hook 690 of the pawl 688 towards surface 670.

Figure 47C:
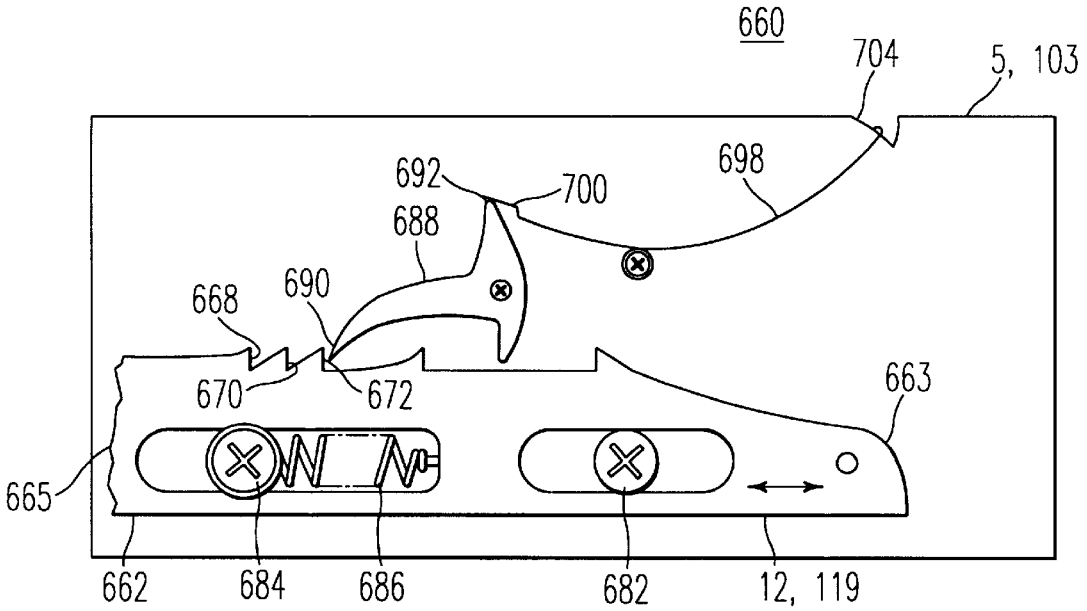

The tooth rack 662 also has a third indentation 672 which represents a final stop position when the hook 690 of the pawl 688 is engaged with the third indentation 672, as shown in FIG. 47*c*. The final stop position maintains the flaps in the fully deflecting position or "fully diffusing" mode. Again, the coiled spring 698 presses on the locking surface 692 of the pawl 688 to urge the hook 690 of the pawl 688 towards surface 672.

Figure 47D:
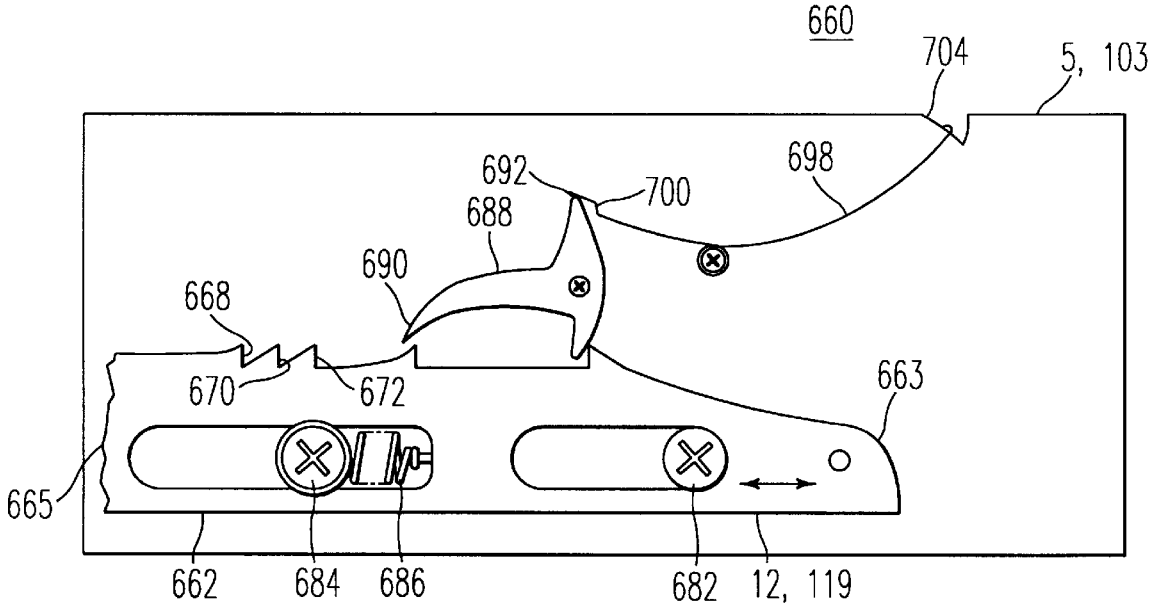
Figure 47E:
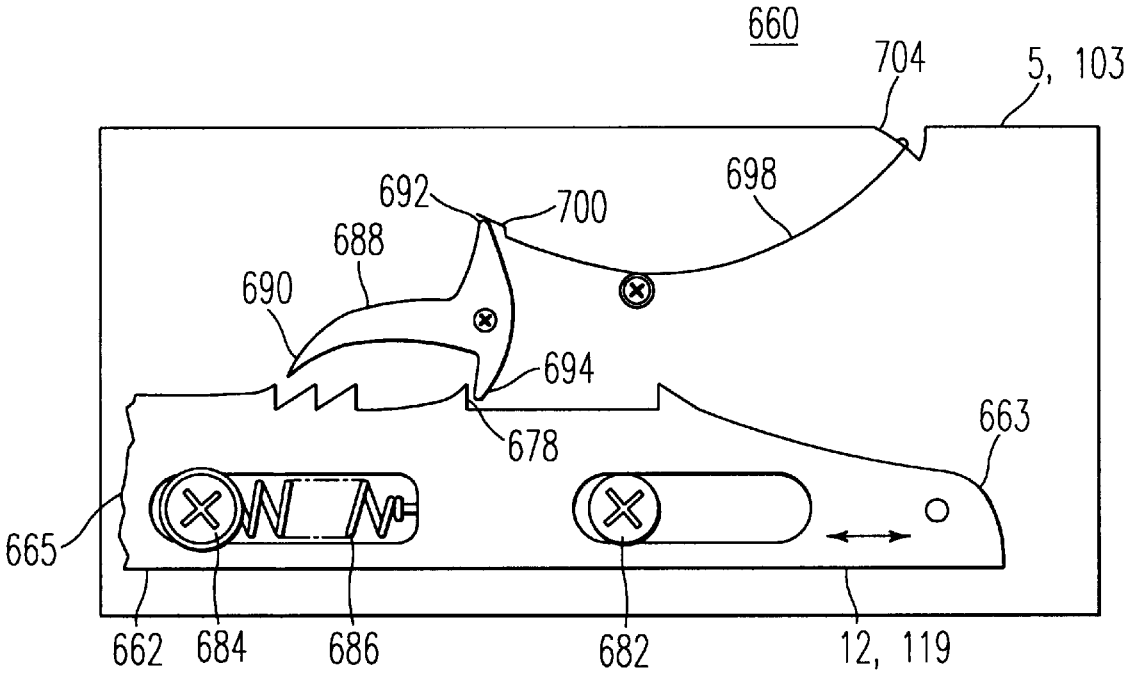

In operation the user can adjust the fifth stop mechanism 660 to the "normal" mode, as shown in FIG. 47*a*, from the "fully deflecting" mode, as shown in FIG. 47*c*, by further depressing the trigger 12 or 119 to which the tooth rack 662 is attached, also known as a trigger portion, at which time the fully deflecting disengagement surface 680 of the tooth rack 662 contacts the reset end 694 of the pawl 688. As the actuator or trigger is further depressed it causes the pawl 688 to rotate so as to lift the hook 690 out of the third indentation 672. When the pawl 688 has rotated far enough the locking surface 692 of the pawl 688 engages a detent 700 of the coiled spring 698. The detent 700 keeps the pawl 688 in a position where the hook 690 is lifted high enough so as not to vengage any of the indentations, as shown in FIG. 47*d*. When the user releases the trigger or actuator the tooth rack 662 is urged by the reset spring 686 to move so that the normal mode engagement surface 678 of the reset channel 676 contacts the reset end 694 of the pawl 688, as shown in FIG. 47*e*, so as to rotate the pawl 688 in a direction so as to disengage the locking surface 692 from the detent 700 and introduce the hook 690 into the first indentation 668 which maintains the deflector in the "normal" mode. The blow dryer can be operated in this mode with no fingers on the trigger or actuator.

If the user desires to maintain the deflector in the "concentrator" mode then the trigger or actuator is depressed so that the tooth rack 662 moves, while the hook 690 slides along the surface of the first indentation 668 until the trigger is depressed so far that the hook 690 is introduced into the second indentation 670. The blow dryer can be operated in this mode with no fingers on the trigger or actuator.

If the user desires to maintain the deflector in the "fully diffusing" mode then the trigger or actuator is depressed so that the tooth rack 662 moves, while the hook 690 slides along the surface of the second indentation 670 until the trigger is depressed so far that the hook 690 is introduced into the third indentation 672. The blow dryer can be operated in this mode with no fingers on the trigger or actuator.

Furthermore, as an alternative, the third, fourth and fifth stop mechanisms 460, 560 and 660, respectively, can be mounted to a plate which is in turn mounted on the barrel or other location of the body of the blow dryer. As an example, the barrel portion of the fifth stop mechanism which includes guide pins 682 and 684, pivot pin 696, fixed pin 702, and notch 704, would be attached to a plate. The plate would then be attached to the body of the blow dryer.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A blow dryer for blowing air and including a barrel having a barrel opening, the blow dryer comprising:

a deflector positioned substantially within the barrel, said deflector having an irregular shape along an outer periphery and being movable between at least an open position in which the barrel opening is opened, and a deflecting position in which the barrel opening is substantially closed, said deflector having at least one aperture through which air can pass when the deflector is in the deflecting position.

2. A blow dryer according to claim 1, wherein said deflector comprises first and second flaps movably mounted at the barrel opening.

3. A blow dryer according to claim 2, wherein said first and second flaps each have facing surfaces that are separated by a gap.

4. A blow dryer according to claim 1, wherein said at least one aperture is a slot.

5. A blow dryer according to claim 4, wherein said slot is oriented substantially perpendicular to said gap.

6. A blow dryer according to claim 1, wherein said at least one aperture has a scallop shape.

7. A blow dryer according to claim 1, wherein said at least one aperture has a serrated shape.

8. A blow dryer for blowing air and including a barrel having a barrel opening, the blow dryer comprising:

a deflector positioned substantially within the barrel, said deflector having an irregular shape along an outer periphery and being movable between at least an open position in which the barrel opening is opened, and a deflecting position in which the barrel opening is substantially closed, wherein said deflector has first and second flaps movably mounted at the barrel opening, and wherein in the deflecting position each of said first and second flaps have facing surfaces which face each other, said facing surfaces being separated by a gap through which air can pass when the deflector is in the deflecting position.

9. A blow dryer according to claim 8, wherein said gap has a width that varies along a length of said facing surfaces.

10. A blow dryer according to claim 9, wherein said first and second flaps each have at least one aperture.

11. A blow dryer for blowing air and including a barrel having a barrel opening, the barrel having a plurality of holes which are disposed around a circumference of the barrel and are spaced along substantially an entire length of the barrel, the blow dryer comprising:

at least one of first rings and second rings, said first rings spaced along the length of the barrel and which extend around the circumference of the barrel for guiding hair, said first rings being positioned so as to not obstruct air flow through the holes, and said second rings spaced along the length of the barrel and which extend around the circumference of the barrel for guiding hair, said second rings being positioned so as to partially obstruct air flow through the holes for diffusing the airflow.

12. A blow dryer for blowing air and including a barrel having a barrel opening at an axial end through which air can flow, the barrel having a plurality of holes which are disposed around a circumference of the barrel and are spaced along substantially an entire length of the barrel, the blow dryer comprising:

a barrel attachment surrounding the barrel so as to partially obstruct an air flow through the plurality of holes.

13. A blow dryer according to claim 12, wherein said barrel attachment is made of a substantially rigid material.

14. A blow dryer according to claim 12, wherein said barrel attachment is a foam material.

15. A blow dryer according to claim 14, wherein said foam material is elastic.

16. A blow dryer according to claim 14, wherein said foam material includes projections.

17. A blow dryer according to claim 16, wherein at least one of said projections extends substantially parallel to the length of the barrel.

18. A blow dryer according to claim 14, wherein said foam material is made of a substantially rigid material.

19. A blow dryer for blowing air and including a barrel and a deflector actuated by an actuator trigger, the blow dryer comprising:

a stop mechanism for stopping the deflector between an open position, an at least one intermediate deflecting position and a fully deflecting position.

20. A blow dryer for blowing air and including a barrel and a deflector actuated by an actuator, the blow dryer comprising:

a stop mechanism having an actuator operationally associated with the deflector for stopping the deflector between an open position, an at least one intermediate deflecting position and a fully deflecting position;

wherein said actuator has a rack gear operationally connected to said actuator which engages with at least two rotatable gears, said at least two rotatable gears being operationally connected with rotating shafts of said deflector, such that a movement of said actuator causes a movement of said rack gear which rotates said at least two gears to thereby cause said movement of the deflector.

21. A blow dryer for blowing air and including a barrel having a barrel opening at an axial end through which air can flow, the barrel having a plurality of holes which are disposed around a circumference of the barrel and are spaced along substantially an entire length of the barrel, the blow dryer comprising:

a barrel attachment surrounding the barrel.

22. A blow dryer for blowing air and including a barrel having a barrel opening, the barrel having a plurality of holes which are disposed around a circumference of the barrel and are spaced along substantially an entire length of the barrel, the blow dryer comprising:

at least one set of rings spaced along the length of the barrel and extending around the circumference of the barrel for guiding hair, said rings being positioned so as to partially obstruct air flow through the holes for diffusing the air flow.

* * * * *

UNITED STATES PATENT AND TRADEMARK OFFICE

CERTIFICATE OF CORRECTION

PATENT NO. : 6,038,782
DATED : March 21, 2000
INVENTOR(S) : Natale Schepisi

It is certified that error appears in the above-identified patent and that said Letters Patent is hereby corrected as shown below:

Column 6,
Line 5, change "inma" to -- in a --; and
Line 15, change "n" to -- an --.

Column 15,
Line 28, change "199" to -- 119 --.

Column 19,
Line 37, change "vengage" to -- engage --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*